US011161646B1

(12) United States Patent
Parrish et al.

(10) Patent No.: US 11,161,646 B1
(45) Date of Patent: Nov. 2, 2021

(54) BOX WITH INTERIOR LIFT MECHANISM

(71) Applicant: Buckeye Corrugated, Inc., Fairlawn, OH (US)

(72) Inventors: Bryan Parrish, Lancaster, PA (US); Jason Landis, Manheim, PA (US)

( * ) Notice: Subject to any disclaimer, the term of this patent is extended or adjusted under 35 U.S.C. 154(b) by 0 days.

(21) Appl. No.: 17/162,201

(22) Filed: Jan. 29, 2021

(51) Int. Cl.

| | |
|---|---|
| ***B65D 5/52*** | (2006.01) |
| ***B65D 5/20*** | (2006.01) |
| ***B65D 5/54*** | (2006.01) |
| ***B65D 5/50*** | (2006.01) |

(52) U.S. Cl.
CPC ..... *B65D 5/5213* (2013.01); *B65D 5/2052* (2013.01); *B65D 5/5023* (2013.01); *B65D 5/541* (2013.01)

(58) Field of Classification Search
CPC .. B65D 5/5213; B65D 5/2052; B65D 5/5023; B65D 5/541; B65D 85/1054; B65D 85/1009; B65D 5/50
USPC ..... 229/120.21, 125.08, 129.1; 206/755, 206/250, 754, 804
See application file for complete search history.

(56) References Cited

U.S. PATENT DOCUMENTS

| | | | | |
|---|---|---|---|---|
| 2,511,211 | A | 6/1950 | Klein et al. | |
| 2,646,875 | A * | 7/1953 | Feder | B65D 5/5213 206/754 |
| 2,680,512 | A | 6/1954 | Young | |
| 3,311,283 | A | 3/1967 | Shimada et al. | |
| 3,768,175 | A | 10/1973 | Hill et al. | |
| 4,646,960 | A | 3/1987 | Challand | |
| 5,603,558 | A | 2/1997 | Zimmer | |
| 5,657,875 | A | 8/1997 | Hirsh, III et al. | |
| 5,682,999 | A | 11/1997 | Larson | |
| 5,765,504 | A | 6/1998 | Evans et al. | |
| 6,431,363 | B1 | 8/2002 | Hacker | |
| 6,523,693 | B1 | 2/2003 | Eggenberger et al. | |
| 6,915,949 | B1 | 7/2005 | Economopoulos | |
| 7,455,182 | B2 | 11/2008 | Merckell | |
| 7,909,168 | B2 | 3/2011 | Virvo | |
| 8,167,124 | B2 * | 5/2012 | Uesugi | B65D 85/1054 206/267 |
| 8,985,329 | B2 | 3/2015 | Ullrich | |
| 9,289,047 | B2 | 3/2016 | Limongi et al. | |

(Continued)

FOREIGN PATENT DOCUMENTS

| | | |
|---|---|---|
| DE | 102018206467 | 10/2019 |
| KR | 101676545 | 11/2016 |

(Continued)

OTHER PUBLICATIONS

YouTube Video, www.youtube.com/watch?v=Sbqxw8EjZW0, published Nov. 25, 2016.

*Primary Examiner* — Christopher R Demeree
(74) *Attorney, Agent, or Firm* — Emerson, Thomson & Bennett, LLC; Roger D. Emerson; Peter R. Detorre

(57) ABSTRACT

The present disclosure is directed to a box for use in packaging, storing and displaying items. The box has a one-dimensional configuration before it is formed and a three-dimensional configuration after it is formed. The three-dimensional configuration is formed from a blank which lies flat and with a plurality of fold lines. The three dimensional configuration of the box includes a base portion, four side portions, two lid portions and a platform within the interior of the box that is capable of moving in a vertical manner.

16 Claims, 19 Drawing Sheets

(56) References Cited

U.S. PATENT DOCUMENTS

| | | | | |
|---|---|---|---|---|
| 9,371,151 | B2 | 6/2016 | Nadeau | |
| 9,394,099 | B2 * | 7/2016 | Kimhi | B65D 85/36 |
| 9,873,542 | B2 | 1/2018 | Krutsch | |
| 10,239,653 | B2 | 3/2019 | Putko | |
| 10,696,446 | B2 | 6/2020 | Lee et al. | |
| 10,875,697 | B2 * | 12/2020 | Sandow | B65D 25/102 |
| 2006/0266811 | A1 | 11/2006 | Clegg et al. | |
| 2008/0118900 | A1 | 5/2008 | Salemi | |
| 2015/0014404 | A1 | 1/2015 | Iwata et al. | |
| 2019/0092517 | A1 * | 3/2019 | Chou | B65D 5/5213 |
| 2019/0092556 | A1 * | 3/2019 | Chou | B65D 5/5213 |

FOREIGN PATENT DOCUMENTS

| | | |
|---|---|---|
| WO | 2013131616 | 9/2013 |
| WO | 2016108120 | 7/2016 |

* cited by examiner

BOX WITH INTERIOR LIFT MECHANISM

TECHNICAL FIELD

The present disclosure generally relates to a box for packaging, storing and displaying items, methods of assembling a box and methods for using the box.

BACKGROUND

Numerous types of boxes have been developed and used for storing, shipping and displaying products. In most cases the size, shape and function of the box depends on the particular needs of the manufacturer or shipper.

While various types of boxes exist for storing and shipping goods and even displaying goods, present box design provides an interior lift mechanism for raising and lowering platform within the interior of the box. This feature of a lift mechanism allows the interior contents of the box to be raised or lifted from the interior of the box within the opening of the box. By lifting the contents of the box from the interior of the box, the box provides a user with easier access to the interior contents of the box. In addition, the box may also function as a display for the contents stored within the interior of the box when the box is in its open configuration. Thus, the lift mechanism of the present box also provides a means for displaying the goods stored within the box. The present disclosure contemplates that these goods may be stored within a second smaller box or other type of packaging material within the interior of the box or not.

SUMMARY

Provided is a box blank. The box blank includes the following features: a base portion having a first side, a second side, a third side and a fourth side; a first sidewall exterior portion which extends from the first side of the base portion and a second sidewall exterior portion which extends from the second side of the base portion; a third sidewall portion which extends from the third side of the base portion, wherein the third sidewall portion has a first side, a second side a third side and a fourth side; a fourth sidewall portion which extends from the fourth side of the base portion, wherein the fourth sidewall portion has a first side, a second side, a third side and a fourth side; a first cover portion which extends from the fourth side of the fourth sidewall portion, the first cover portion having a first side, a second side, a third side and a fourth side; a second cover exterior portion which extends from the third side of the third sidewall portion, wherein the second cover exterior portion has a first side, a second side, a third side and a fourth side; a second cover interior portion which extends from the third side of the second cover exterior portion, wherein the second cover interior portion has a first side, a second side, a third side and a fourth side; a first platform intermediate portion which extends from the third side of the second cover interior portion, wherein the first platform intermediate portion has a first side, a second side, a third side and a fourth side; a platform portion which extends from the third side of the first platform intermediate portion, wherein the platform portion has a first side, a second side, a third side and a fourth side; a second platform intermediate portion which extends from the third side of the platform portion, wherein the second platform intermediate portion has a first side, a second side, a third side and a fourth side; and a first cover interior portion which extends from the third side of the second platform intermediate portion, wherein the first cover interior portion has a first side, a second side, a third side and a fourth side.

According to further aspects of the present teaching, the third sidewall portion includes a first side insert which extends from the first side of the third sidewall portion and a second side insert which extends from the second side of the third sidewall portion and the fourth sidewall portion includes a first side insert which extends from the first side of the fourth sidewall portion and a second side insert which extends from the second side of the fourth sidewall portion.

According to further aspects of the present teaching the first sidewall portion includes a first sidewall interior portion which extends from the first side of the first sidewall portion and the second sidewall portion includes a second sidewall interior portion which extends from the second side of the second sidewall portion.

According to further aspects of the present teaching, the first sidewall interior portion includes at least one tab which extends from its second side and the base portion includes at least one slot corresponding to said tab and the second sidewall interior portion includes at least one tab which extends from its second side and the base portion includes at least one slot corresponding to said tab.

According to further aspects of the present teaching, the first cover portion includes a first side portion which extends from the first side of the first cover portion and a second side portion which extends from the second side of the first cover portion; and the second cover exterior portion includes a second side portion which extends from the first side of the second cover exterior portion and a second side portion which extends from the second side of the second cover exterior portion.

According to further aspects of the present teaching, the box blank includes a cutout which overlaps a portion where the second cover exterior portion meets the second cover interior portion.

According to further aspects of the present teaching, the first cover portion includes a primary perforated strip having a first side, a second side, a third side and a fourth side, wherein the primary perforated strip extends from the fourth side of the first cover portion and a secondary perforated strip which extends from the fourth side of the primary perforated strip.

According to further aspects of the present teaching the box blank includes a first hinge support which overlaps a portion where the fourth side of the platform portion meets the first platform intermediate portion; and a second hinge support which overlaps a portion where the third side of the platform portion meets the second platform intermediate portion.

According to further aspects of the present teaching, the first hinge support and the second hinge support each include a first linear cutout and a second linear cutout on a side opposing the first linear cutout.

According to further aspects of the present teaching, the platform portion includes a first side support portion which extends from the first side of the platform portion, and a second side support portion which extends from the second side of the platform portion.

According to further aspects of the present teaching, the first side support portion of the platform portion includes a first side insert tab portion at a first end of the first side support portion and a second side insert tab portion at a second opposing end of the first side support portion, and the second side support portion of the platform portion includes a first side insert tab portion at a first end of the second side support portion and a second side insert tab portion at a second opposing end of the second side support portion.

According to further aspects of the present teaching, the first cover portion includes a bottom surface having an applied adhesive and/or the first cover interior portion comprises a top surface having an applied adhesive.

According to further aspects of the present teaching, the box blank includes: a fold line between the first sidewall exterior portion and the base portion; a fold line between the second sidewall exterior portion and the base portion; a fold line between the third sidewall portion and the base portion; a fold line between the fourth sidewall portion and the base portion; a fold line between the fourth sidewall portion and the first cover portion; a fold line between the third sidewall portion and the second cover exterior portion; a fold line between the second cover exterior portion and the second cover interior portion; a fold line between the second cover interior portion and the first platform intermediate portion; a fold line between the first platform intermediate portion and the second cover interior portion; a fold line between the first platform intermediate portion and the platform portion; a fold line between the platform portion and the second platform intermediate portion; a fold line between the second platform intermediate portion and the first cover interior portion; a fold line between the first sidewall exterior portion and the first sidewall interior portion; a fold line between the second sidewall exterior portion and the second sidewall interior portion; a fold line between the third sidewall portion and the first side insert of the third sidewall portion; a fold line between the third sidewall portion and the second side insert of the third sidewall portion; a fold line between the fourth sidewall portion and the first side insert of the fourth sidewall portion; a fold line between the fourth sidewall portion and the second side insert of the fourth sidewall portion; a fold line between first cover portion and the first side portion of the first cover portion; a fold line between the first cover portion and the second side portion of the first cover portion; a fold line between the second cover exterior portion and the first side portion of the second cover exterior portion; a fold line between the second cover exterior portion and the second side portion of the second cover exterior portion; a first perforation line between the first cover portion and the primary perforated strip; a second perforation line between the primary perforated strip and the secondary perforated strip; a fold line between the platform portion and the first side support portion of the platform portion; a fold line between the platform portion and the second side support portion of the platform portion; a fold line between the first side support portion and the first side insert tab portion of the first side support portion of the platform portion; a fold line between the first side support portion and the second side insert tab portion of the first side support portion of the platform portion; a fold line between the second side support portion and the first side insert tab portion of the second side support portion of the platform portion; and, a fold line between the second side support portion and the second side insert tab portion of the second side support portion of the platform portion.

Also provided is a method of forming a box. The method includes the following steps: folding the first sidewall portion and the second sidewall portion upwards with respect to the base portion; folding the first sidewall interior portion with respect to the first sidewall exterior portion and inserting the at least one tab extending from the first sidewall interior portion within the at least one corresponding slot within the base; folding the second sidewall interior portion with respect to the second sidewall exterior portion and inserting the at least one tab extending from the second sidewall interior portion within the at least one corresponding slot within the base; folding the third sidewall portion upwards with respect to the base portion; folding the fourth sidewall portion upwards with respect to the base portion; folding the first side insert and the second side insert of the third sidewall portion inward with respect to a top surface of the third sidewall portion and inserting the first side insert between the first sidewall exterior portion and first sidewall interior portion and second side insert between the second sidewall exterior portion and second sidewall interior portion; folding the first side insert and the second side insert of the fourth sidewall portion inward with respect to a top surface the fourth sidewall portion and inserting the first side insert between the first sidewall exterior portion and first sidewall interior portion and second side insert between the second sidewall exterior portion and second sidewall interior portion; folding the first cover portion with respect to the fourth sidewall portion towards a top surface of the base portion; folding the first side portion and the second side portion of the first cover portion inward with respect to a bottom surface of the first cover portion; folding the second cover exterior portion with respect to the third sidewall portion towards a top surface of the base portion; folding the first side portion and the second side portion of the second cover exterior portion inward with respect to a bottom surface of the second cover exterior portion; folding the second cover interior portion over the second cover exterior portion and bringing the first platform intermediate portion, platform portion, first side portion of platform portion, second side portion of platform portion, second platform intermediate portion and first cover interior portion over the top surface of the base of the box as a unit; folding the first side support portion and second side support portion in a downward direction with respect to the platform portion; folding the first side insert tab portion and second side insert tab portion of the first side support portion of the platform in an inward direction with respect to the platform to position the first side insert tab portion and second side insert portion under the platform; folding the first side insert tab portion and second side insert tab portion of the second side support portion of the platform in an inward direction with respect to the platform to position the first side insert tab portion and second side insert tab portion under the platform; and securing the first cover interior portion to a bottom surface of the first cover portion.

According to further aspects of the present teaching, the step of securing the first cover interior portion to the bottom surface of the first cover portion includes application of an adhesive.

Also provided is a box having an interior lift mechanism. The box includes the following features: an exterior box structure comprising a first sidewall, a second sidewall, a third sidewall, a fourth sidewall, a bottom surface and at least two cover portions; and a platform portion positioned over the bottom surface of the box within the interior of the box, wherein the platform portion extends on a first side to a first cover interior portion and wherein the platform portion extends on a second opposing side to a second cover interior portion, wherein the first cover interior portion of the platform portion and the second cover interior portion of the platform portion are connected respectively to a bottom surface of a first cover and to a bottom surface of a second cover of the box.

According to further aspects of the present teaching, the bottom surface of the box includes a single bottom portion or more than one bottom cover portion.

According to further aspects of the present teaching, the platform portion includes a first side support portion and a second side support portion each of which extends along a length of the platform portion, wherein the each of the first side support portion and second side support portions include a first side insert tab portion at one end of the respective side support portion and a second side insert tab portion at a second opposing end of the side insert tab portion.

According to further aspects of the present teaching, the first cover interior portion extending from the platform is adhesively attached to the bottom surface of the first cover and the second cover interior portion extending from the platform is adhesively attached to the bottom surface of the second cover.

According to further aspects of the present teaching, a bottom surface of a first cover portion is adhesively attached to an first cover interior portion which extends from the platform portion and the second cover interior portion extends from a second cover portion and is folded at a fold line under a bottom surface of the second cover, wherein box includes a first hinge support between the platform portion and the first cover interior portion and a second hinge support between the platform portion and the second cover interior portion, wherein the box includes a primary perforation strip which extends from the first cover portion at a first perforation line and a secondary perforation strip which extends from the primary perforation strip at a second perforation line and wherein the second cover portion includes a cutout along the fold line between the second cover portion and the second cover interior portion.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the invention in sufficient detail to enable one of ordinary skill in the art to which the invention pertains to make and use the invention.

DETAILED DESCRIPTION

The present disclosure is directed to a box having an interior lift mechanism or levitation device within its interior. The lift mechanism/levitation device includes a platform which is connected to the inner sides of two hinged box covers. The lift mechanism/levitation device functions to raise and lower the platform within the interior of the box with the opening and closing of the hinged box covers. These and other features of the box are discussed in the detail description below.

The present disclosure overcomes the foregoing and other shortcomings and drawbacks of boxes heretofore known for use in various environments and applications. While various embodiments are discussed in detail herein, it will be understood that the invention is not limited to these embodiments. On the contrary, the invention includes all alternatives, modifications and equivalents as may be included within the spirit and scope of the present invention.

The present disclosure relates to a box having both a first flat and one-dimensional configuration and a second three-dimensional configuration. The box transitions between the first configuration to the second configuration through folding and/or unfolding and shaping of its components. The box may be used as a packaging device to store items placed within it for sale. In certain configurations, the box is capable of storing a second smaller box within its interior space. The box has an closed configuration which allows for protection and transport of items stored within it and an open configuration which provides access to and allows for display of items stored within it. Accordingly, the box may be used as a general storing container and as a display device when it is opened.

The box includes an interior lift mechanism (also referred to as a levitation device) which includes a platform attached to the inner sides of two hinged covers. Upon opening the hinged covers, the lift mechanism causes the platform to rise within the interior of the box. The lift mechanism further causes the platform to lower within the interior of the box upon closing the hinged covers. The platform is capable of holding various types of packaged and unpackaged items and may further be used as a display of items stored within the box when the box is in its opened configuration. The platform further includes various support structures, as described in greater detail below, which allows for the platform to hold items of relatively heavier weight.

Figure 1:
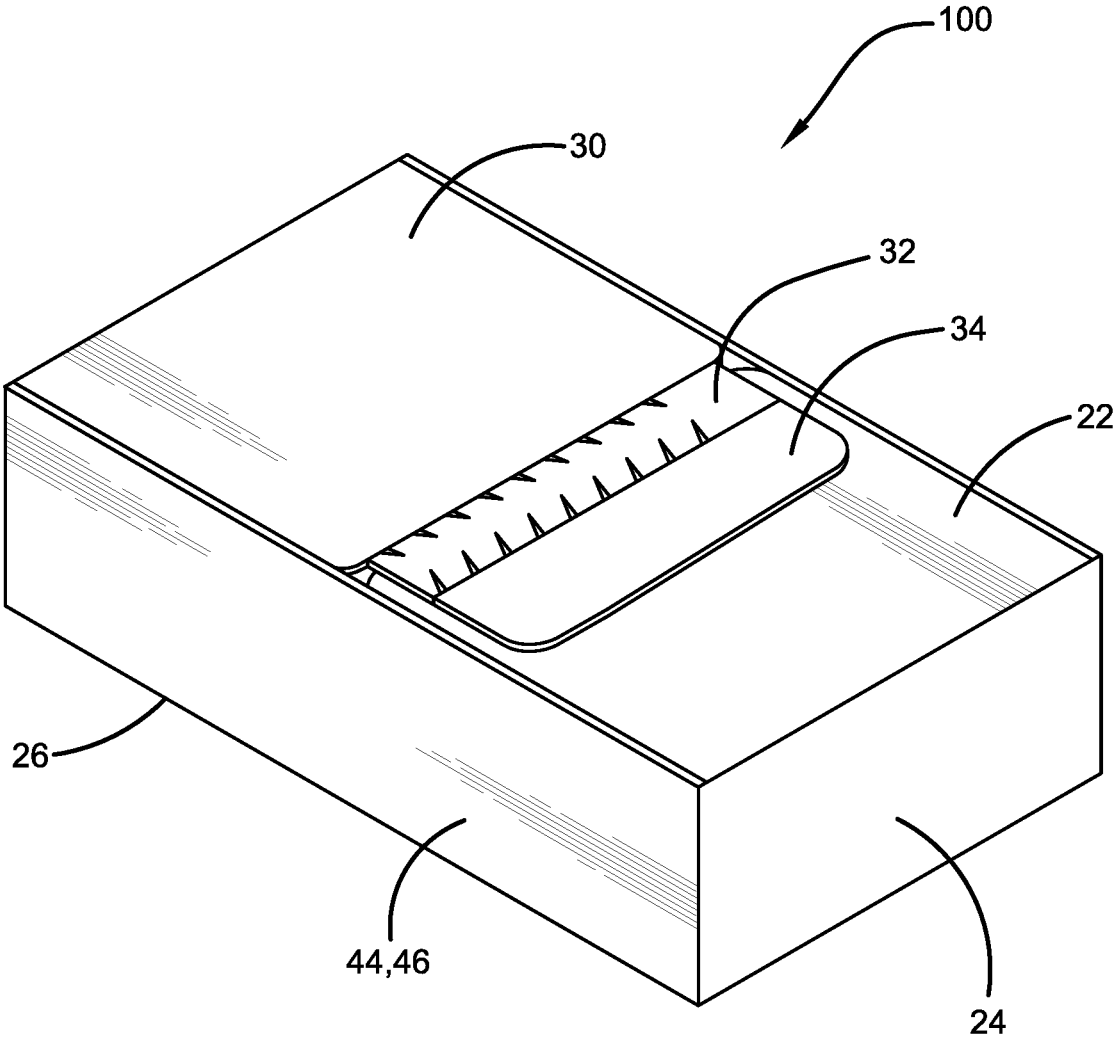
FIG. 1 is an example of a first embodiment of a box according to the present disclosure shown in a closed configuration and perspective view.
Figure 2:
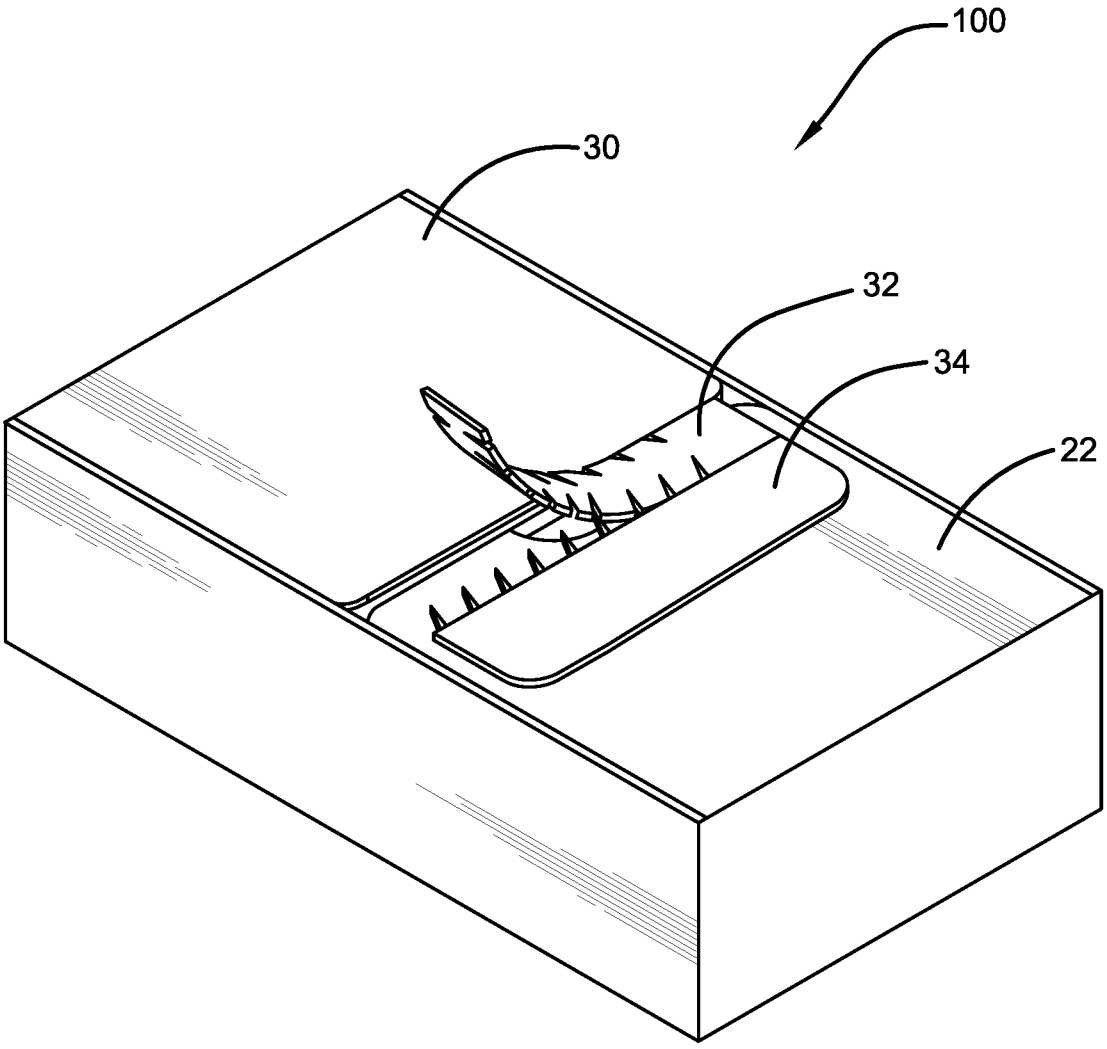
FIG. 2 is a perspective view of the box of FIG. 1 with a pull tab being opened.
Figure 3:
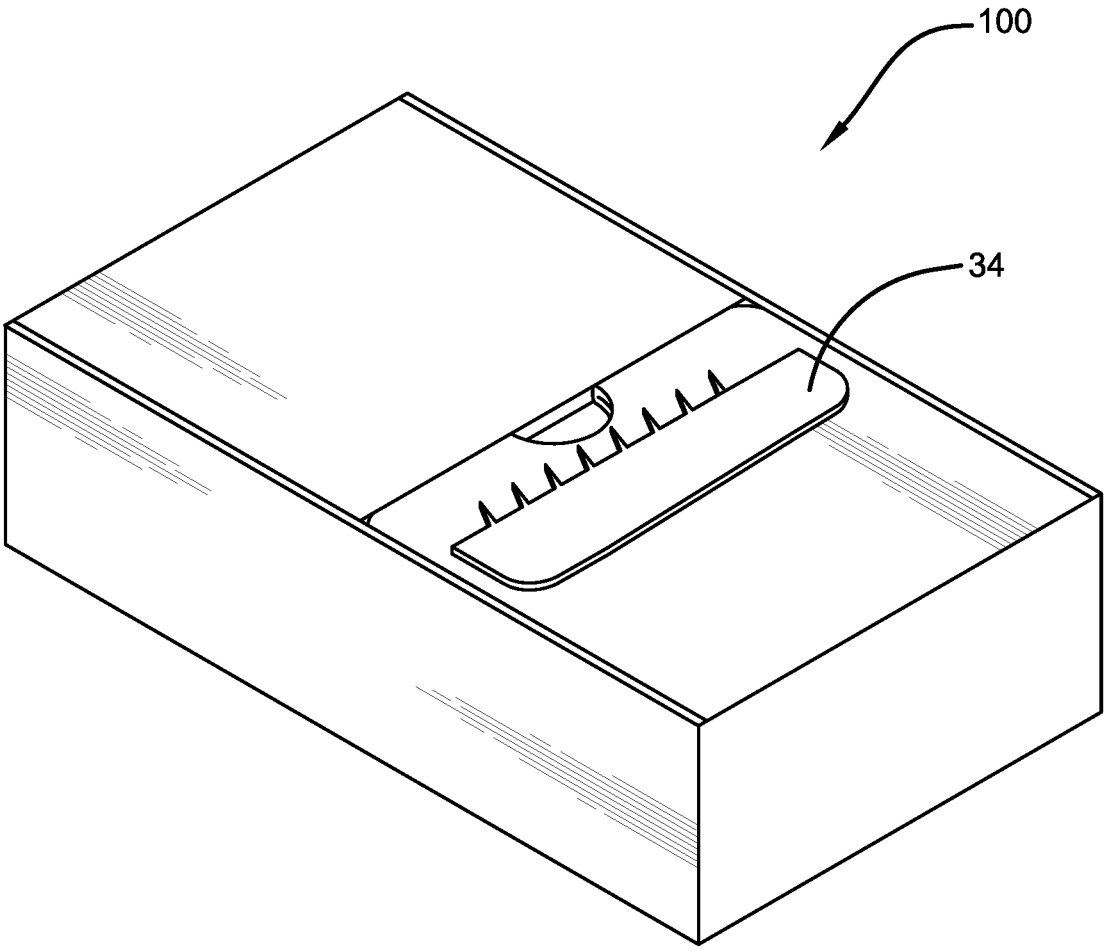
FIG. 3 is a perspective view of the box of FIG. 1 with the pull tab being removed.

FIGS. 1-3 of the drawings illustrate an exemplary embodiment of the inventive box disclosed herein shown in a closed configuration. As shown, in FIGS. 1-3, the box 100 includes a primary perforated strip 32 and a secondary perforated strip 34 which extends from box cover 30. Secondary perforated strip is adhered or attached to cover 22. To open the box, primary perforated strip 32 is lifted and pulled along its perforation lines and removed from the top of the box. Alternatively, to open the box, the secondary perforated strip may be pulled upwards and detached from the top portion of cover 22. In certain embodiments, a semicircular cutout 76 may be present under primary perforated strip 32. This cutout provides the user with access to covers 30 and 22 and allows the user to insert his or her finger or a tool under one or more of the box covers to open the box.

Figure 4:
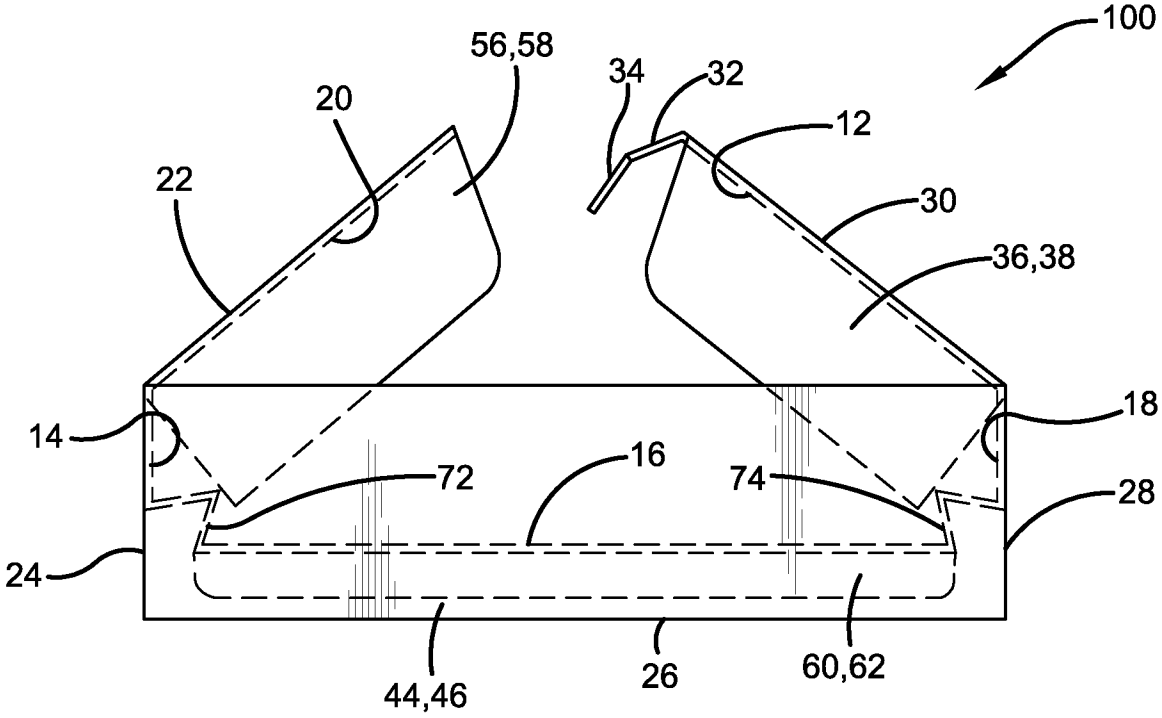
FIG. 4 is a side and cross sectional view of the box of FIG. 1 showing the top hinged box covers beginning to open.
Figure 5:
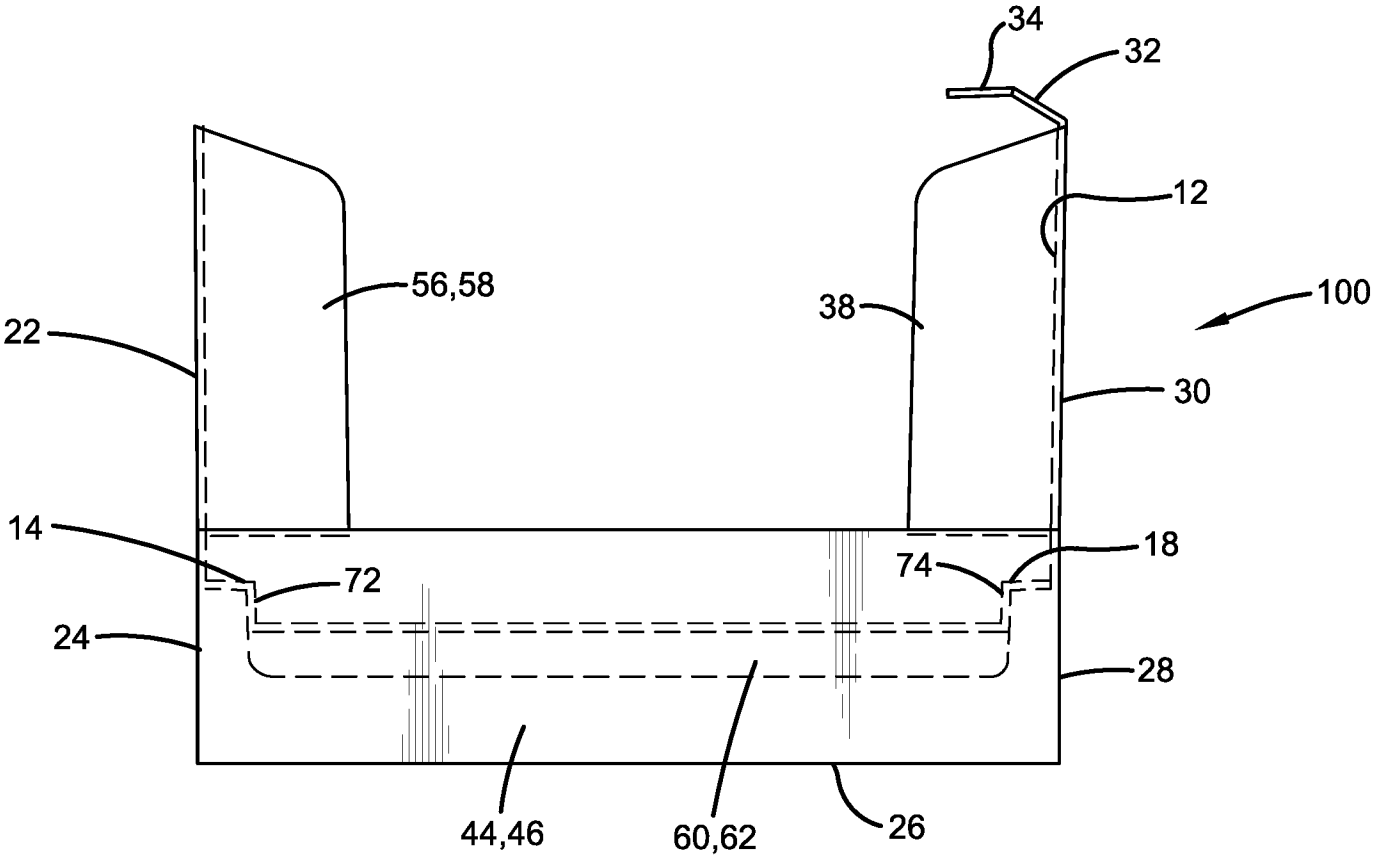
FIG. 5 is a side and cross sectional view of the box of FIG. 1 showing the top hinged box covers opened at 90° with respect to the body of the box.
Figure 6:
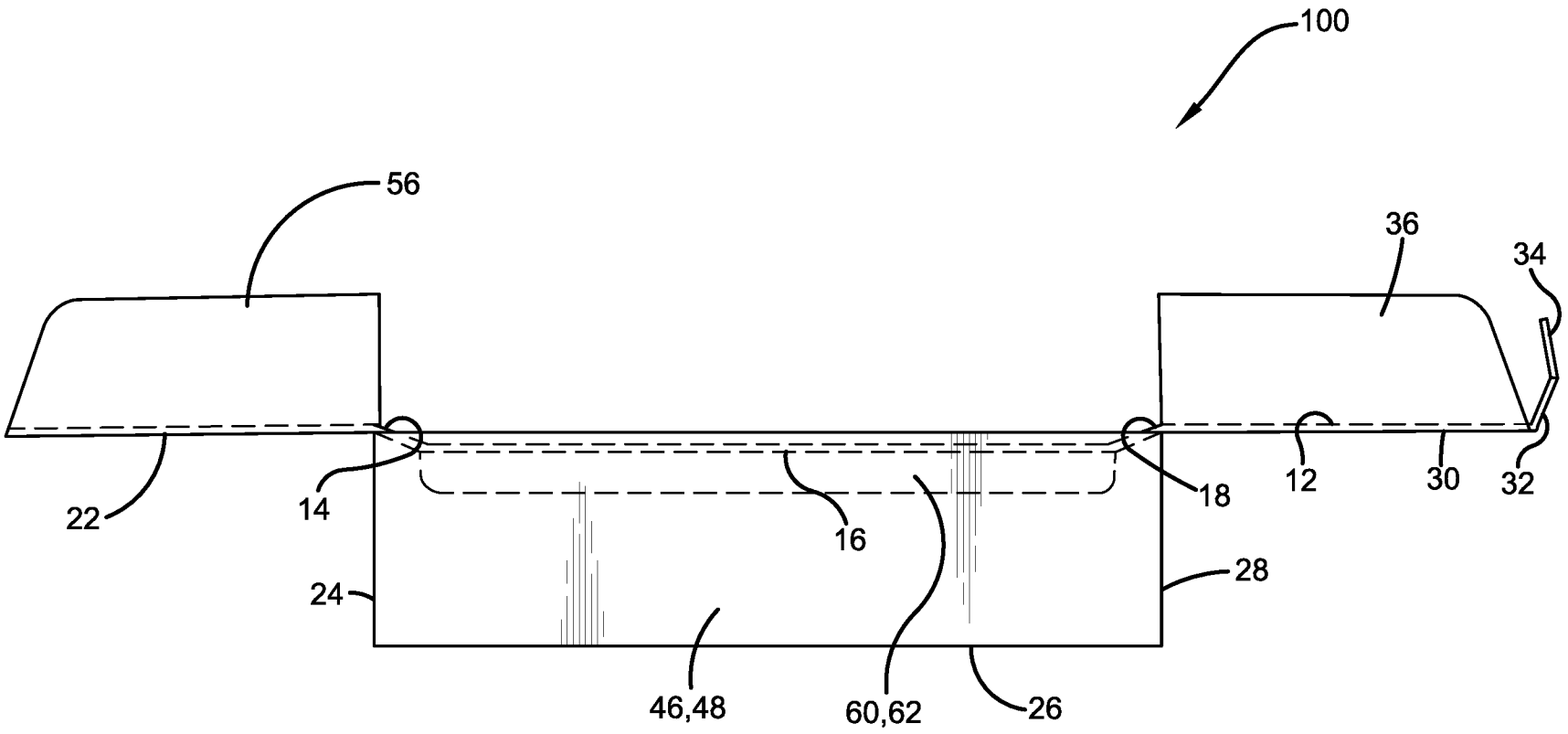
FIG. 6 is a side and cross sectional view of the box of FIG. 1 showing the top hinged box covers opened at 180° with respect to the body of the box.

FIGS. 4-6 of the drawings provide a cross sectional view of the interior of the box illustrating how the lift mechanism moves of the platform 16 within the interior of the box with the opening and closing of covers 30 and 22. FIG. 4 shows the platform 16 beginning to rise up within the interior of the box upon opening the box covers. The platform continues to rise within the interior of the box as the box covers approach a position of 90° with respect to the body of the box as illustrated within FIG. 5. FIG. 6 shows the platform 16 in its full display position with the box covers more fully open (e.g., 180° with respect to the body of the box). It should be understood, however, that the position of the platform with respect to the position of the box covers is not to be limited to the exact positions provided in FIGS. 4-6 and that FIGS. 4-6 are only provided for illustrative purposes. For example, it is contemplated in certain embodiments that the platform may be in its full display position when the box covers are less than 180° with respect to the body of the box.

Figure 7:
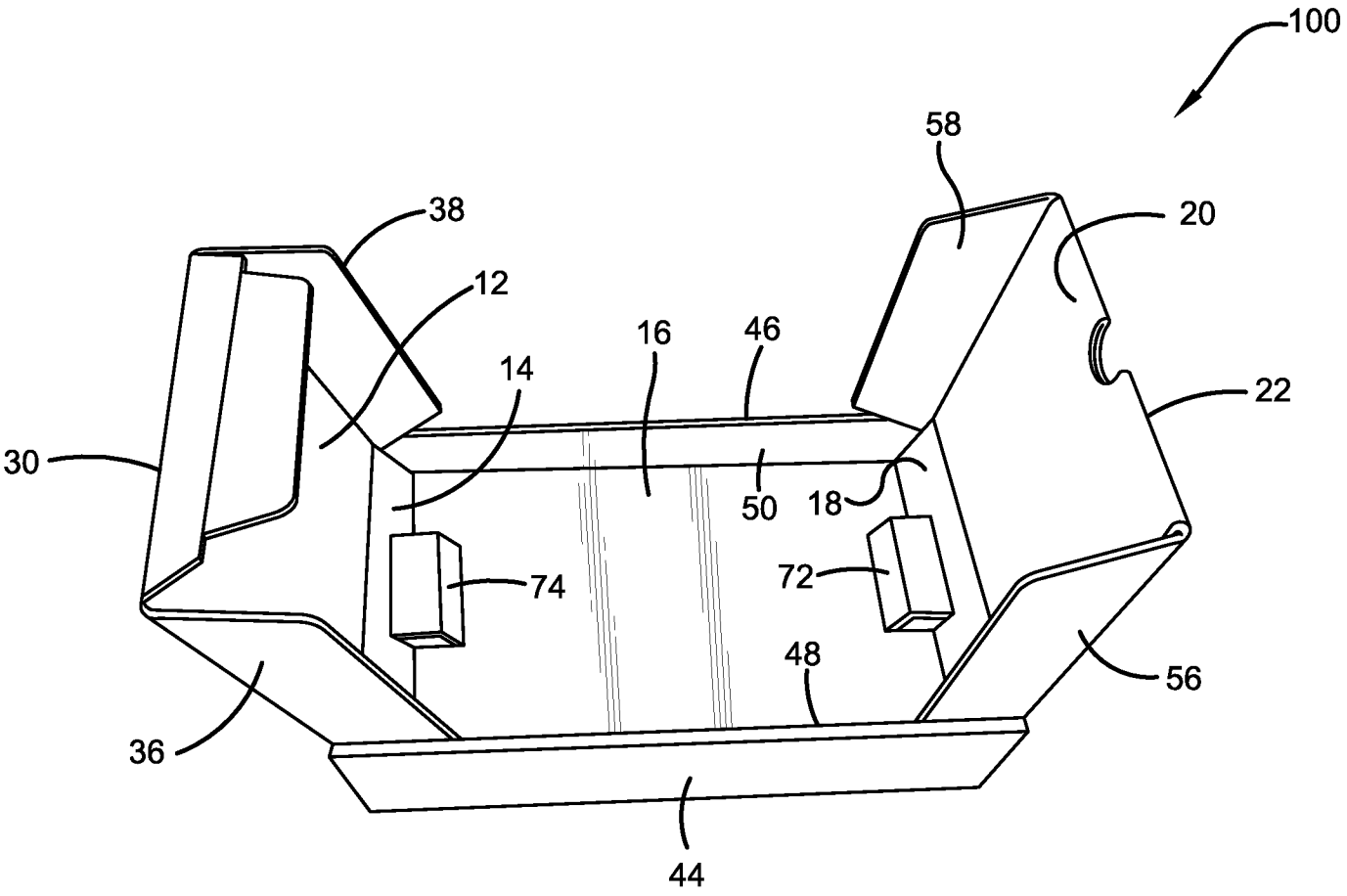
FIG. 7 is a perspective top view of the box of FIG. 1 in an open configuration showing an interior platform and lift mechanism.
Figure 8:
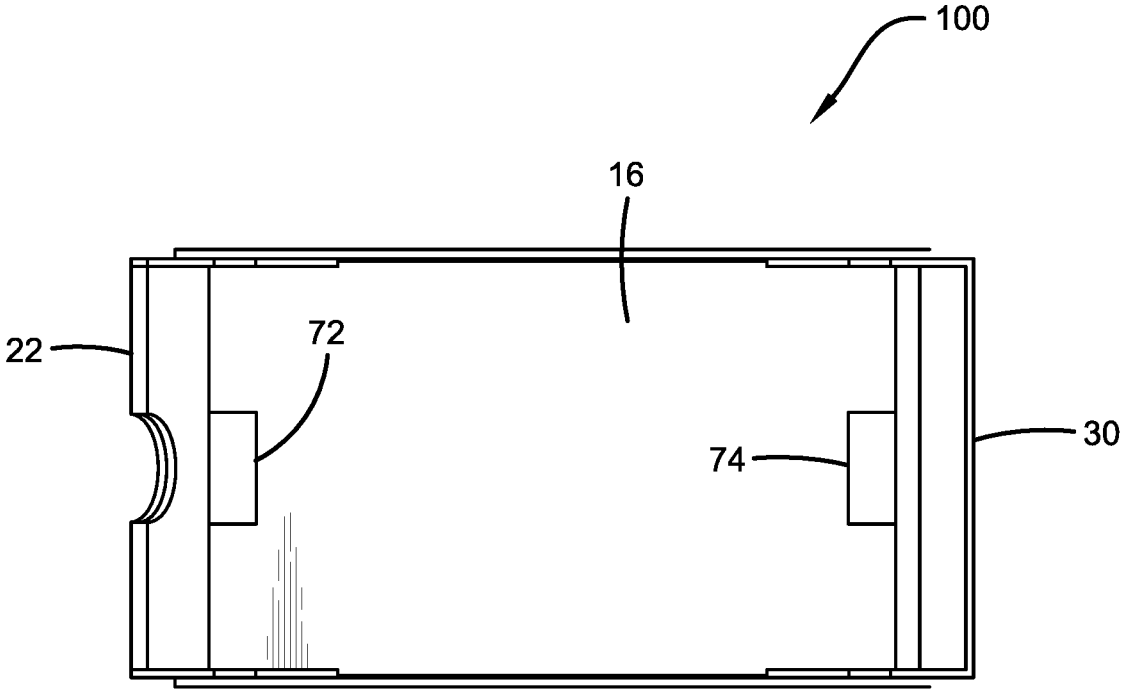
FIG. 8 is a top view of the box of FIG. 1 in an open configuration.
Figure 9:
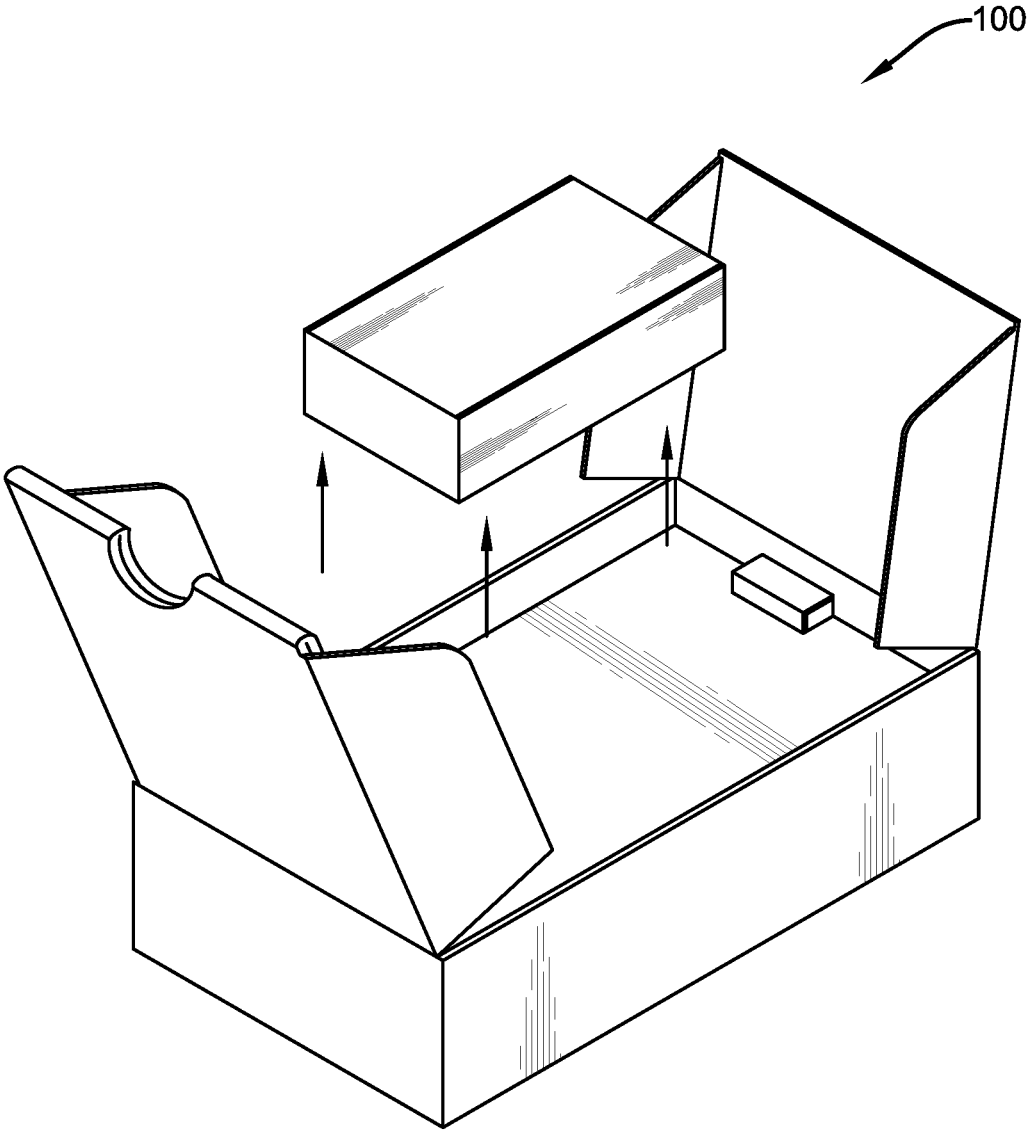
FIG. 9 is a perspective view of the box of FIG. 1 and a smaller box capable of being stored within the box of FIG. 1.

FIG. 7 provides a top view which illustrates the lift mechanism of the box. As shown in FIG. 7, the platform 16 is connected to the interior portion 12 of cover 30 by intermediate portion 14 and to the interior portion 20 of cover 22 by intermediate portion 18. This feature allows the platform to be connected to the covers and to be lifted in an upwards direction upon opening of the covers through various hinges and fold lines between the platform and the cover as well as through the hinged covers themselves. FIG. 7 further illustrates first hinge support 74 which connects the platform 16 to intermediate portion 14 and second hinge support 72 which connects the platform 16 to intermediate portion 18. These hinge supports, described in greater detail below, provide structural support to the platform allowing the platform to house heavier weighted items. For example, FIG. 9 illustrates the possibility of the box housing a second smaller box of packaged goods. This second box may house any type of goods. Moreover, such goods may be of relatively considerable weight. For example, it is contemplated that the goods of the second smaller box may house golf balls which may be fully supported by the platform of the main box at various height positions for display.

Figure 10:
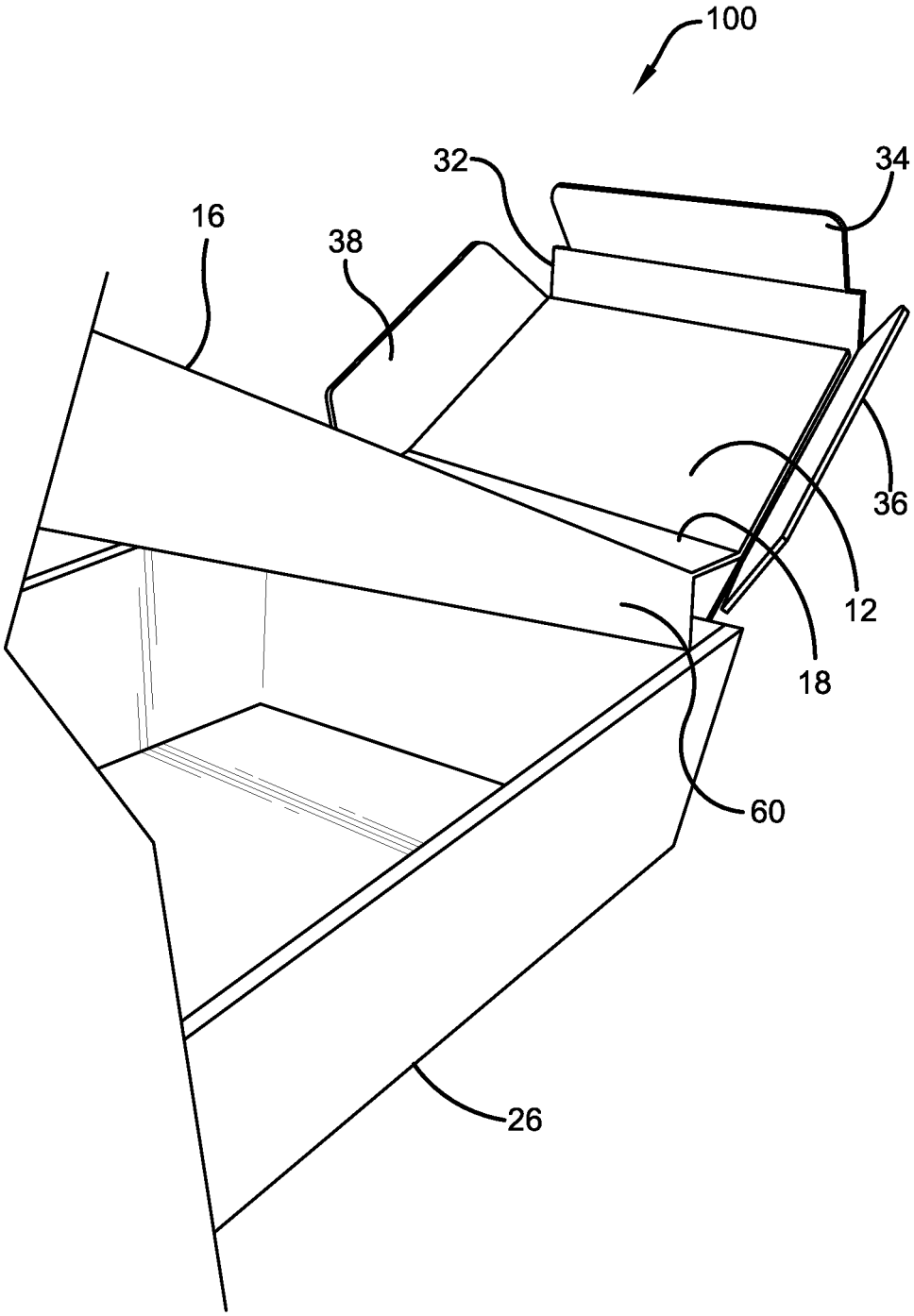
FIG. 10 is a sectional view of the box of FIG. 1 which shows the platform and lift mechanism.
Figure 11:
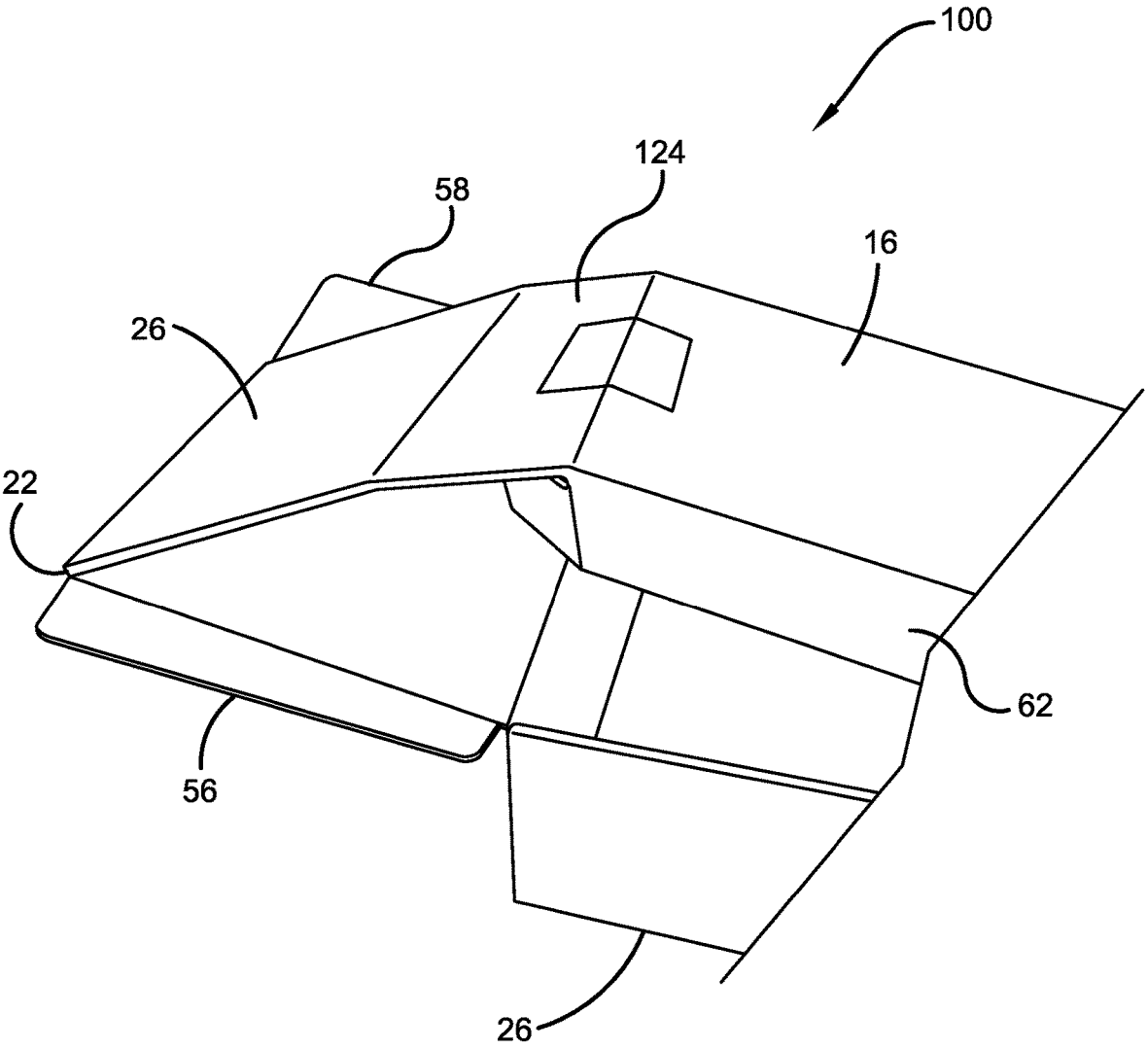
FIG. 11 is a sectional view of the box of FIG. 1 which shows the platform and lift mechanism.
Figure 14:
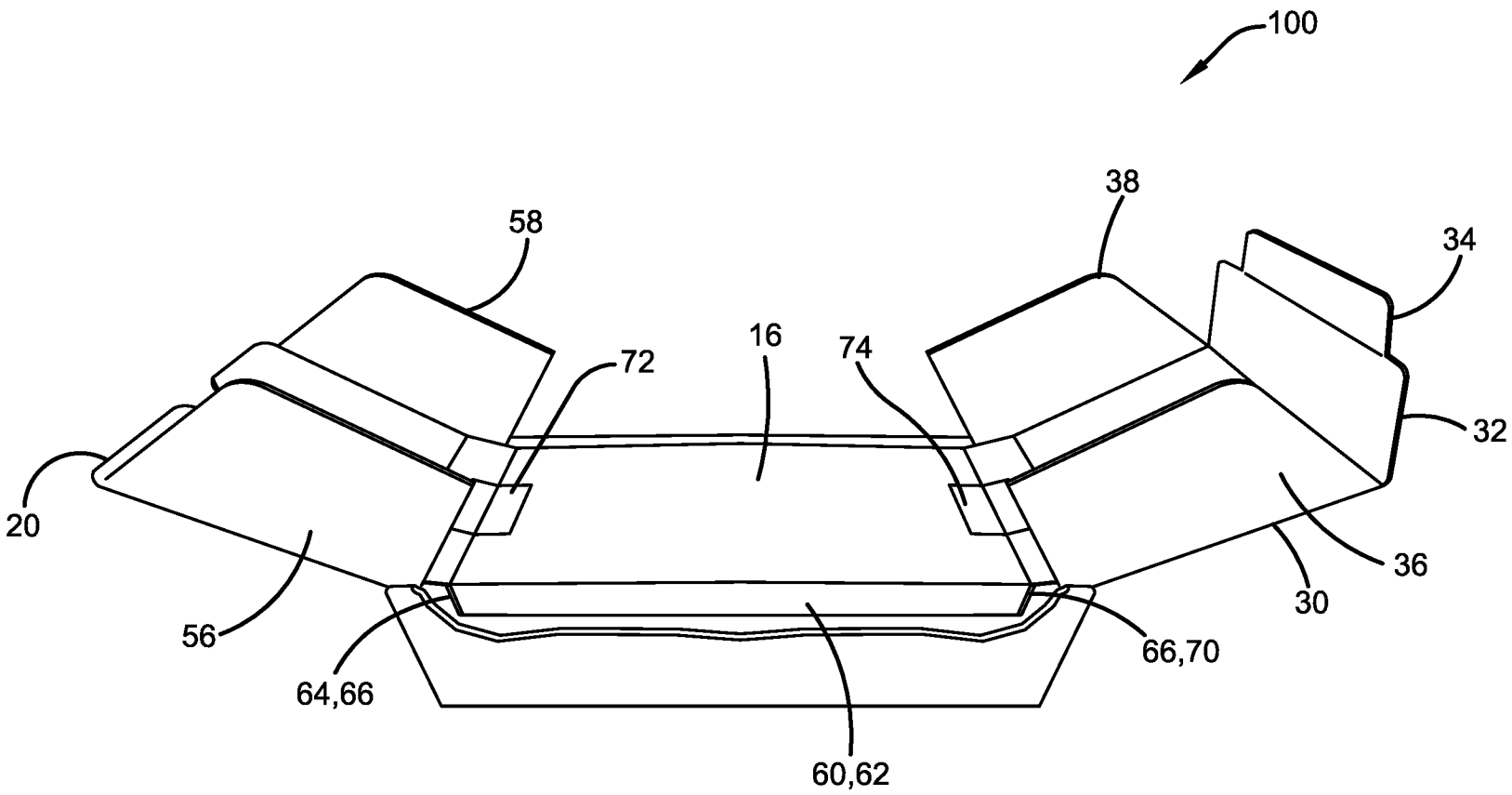
FIG. 14 is a side perspective view of the box of FIG. 1 in an open configuration providing a sectional view showing the platform within the interior of the box.

FIGS. 10, 11 and 14 provide sectional views of the box which illustrate the sidewalls 60 and 62 which extend downward from the platform 16 along the length of the platform. These sidewalls provide structural support to the platform as the platform rests on the top side of the bottom portion of the box when the box is in its closed configuration, thereby allowing the platform to house and support heavier weighted items without causing structural damage to the platform. In certain embodiments, these sidewalls 60 and 62 may further include side insert portions (also referred to as tabs or side insert tab portions) folded inward at each of the four corners of the overall platform providing further structural integrity, shape and support to the platform in its various positions, particularly when the platform rests on the top surface of the bottom portion of the box.

Figure 12:
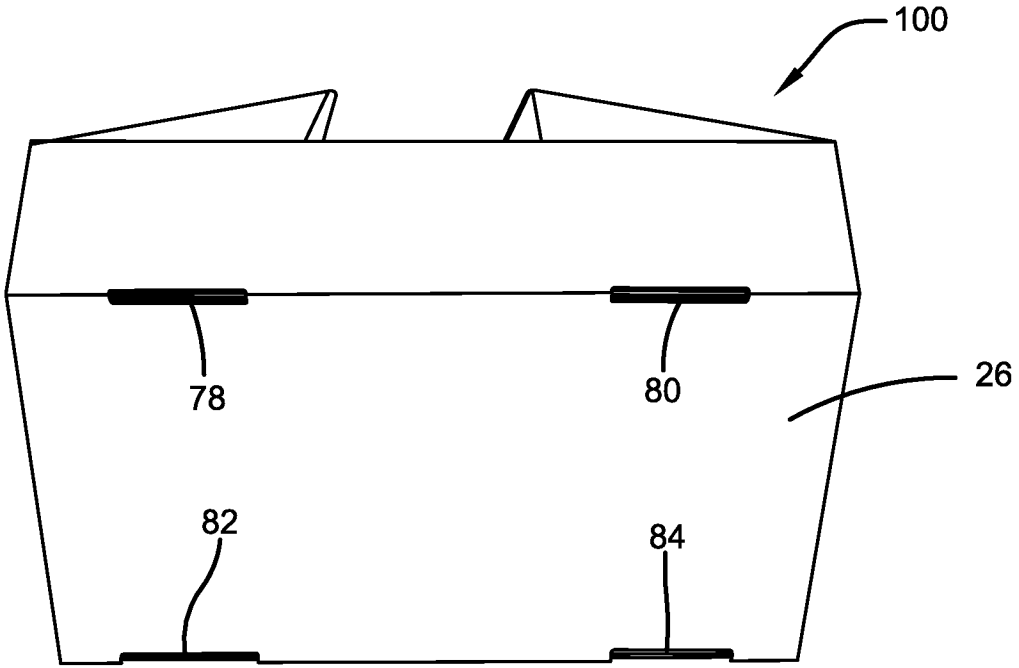
FIG. 12 is a perspective view of the bottom of box of FIG. 1.
Figure 13:
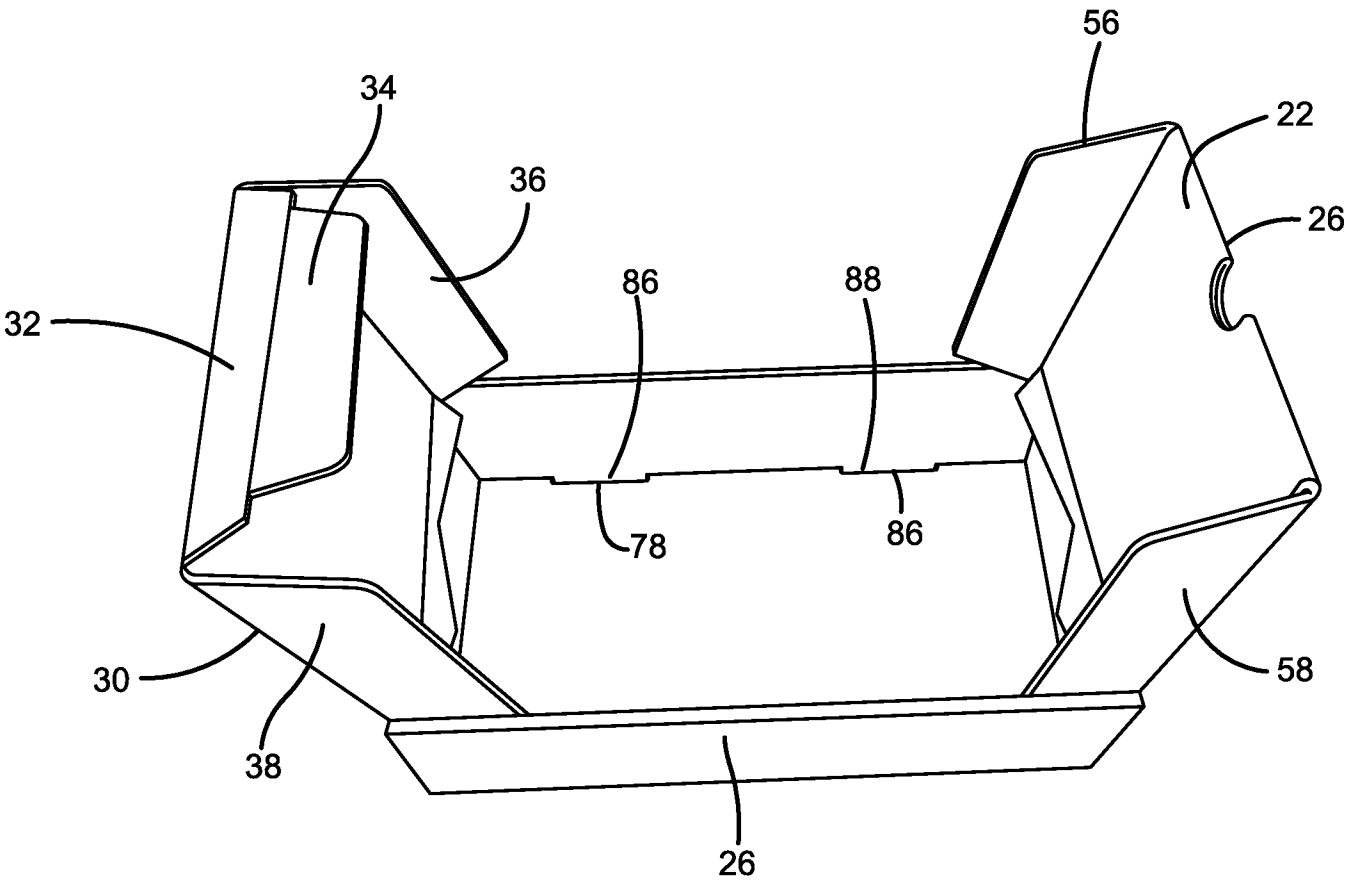
FIG. 13 is a top perspective view of the box of FIG. 1 providing a sectional view of the interior of the box without the platform.

FIGS. 12 and 13 illustrate the interior sidewalls of the box. These interior sidewalls include tabs 86, 88, 90 and 92 which fit within slots 78, 80, 82 and 84 on the bottom portion of the box as shown in FIG. 12 allowing for formation of a portion of the body of the box.

Figure 15:
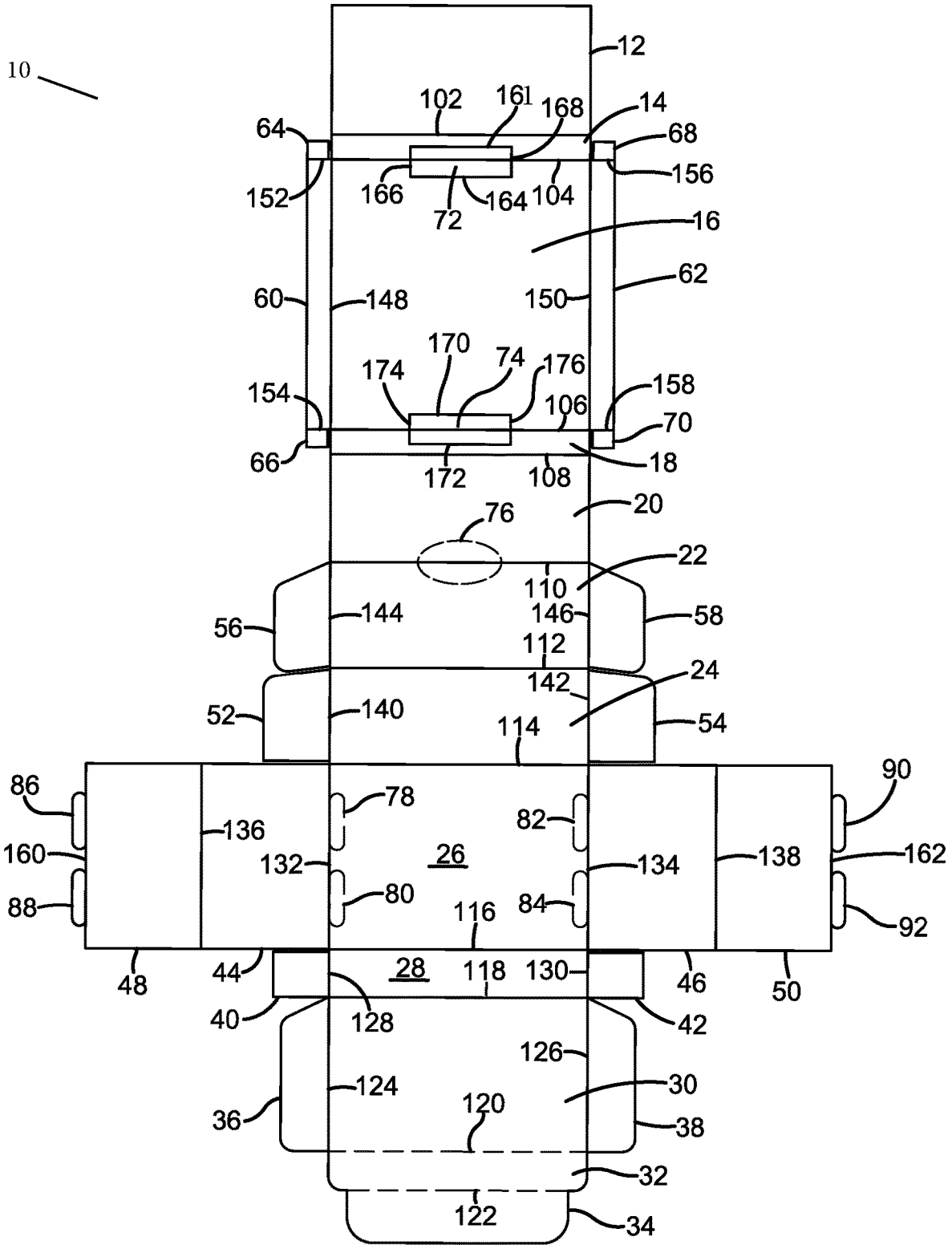
FIG. 15 is a top view of a box blank which may be folded and shaped to form the box of FIG. 1.

Formation of the box will now be discussed with reference to FIG. 15. Before it is formed, the box has a one-dimensional configuration and comprises a blank 10 with a plurality of fold lines. The blank may be initially flat. The blank may be folded along its fold lines to form a three-dimensional configuration of the box. The blank includes an outer side and an inner side. The outer side of the blank forms a portion of the exterior facing surface and a portion of the interior facing surface of the box when it is in its three-dimensional configuration. The inner side of the blank forms a portion of the interior facing surface and a portion of the exterior facing surface of the box when it is in its three-dimensional configuration. The blank may be made of any material known by persons of ordinary skill in the art to be suitable for forming a box.

According to certain aspects of the present teaching, the blank 10 includes a plurality of different sections referred to herein as portions which are separated by various fold lines. Formation of the box from its one-dimensional configuration to its three-dimensional configuration may begin with the base portion 26 which forms the bottom of the box. The base portion 26 is surrounded by four side portions which form the sidewalls of the box. These side portions include first sidewall exterior portion 44, second sidewall exterior portion 46, third sidewall portion 24, and fourth sidewall portion 28. First sidewall portion 44 includes an extended portion referred to as first sidewall interior portion 48. Second sidewall portion 46 includes an extended portion referred to as second sidewall interior portion 50. Third sidewall portion 24 has a first side, second side, top side and a bottom side and includes a first side insert 52 adjacent its first side and a second side insert 54 adjacent its second side. Fourth sidewall portion 28 includes a first side, second side, top side, and a bottom side and includes a first side insert 40 adjacent its first side and a second side insert 42 adjacent its second side.

According to certain aspects of the present teaching, the base portion 26 may include at least one slot or cutout. This slot or cutout may be positioned along the perimeter or sides of the base portion 26. According to certain teachings, the base portion 26 includes two slots 78 and 80 adjacent the perimeter of its first side portion and two slots 82 and 84 adjacent the perimeter of its second side portion.

According to certain aspects of the present teaching, first sidewall interior portion 48 and second sidewall interior portion 50 may include at least one tab. This tab may be positioned along the perimeter of a side edge of the first sidewall interior portion 48 and second sidewall interior portion 50. According to certain teachings, the first sidewall interior portion 48 includes two tabs 86 and 88 adjacent side edge 160 and the second sidewall interior portion 50 includes two tabs 90 and 92 adjacent side edge 162.

In forming the box, first sidewall exterior portion 44 is folded upward with respect to base portion 26 along fold line 132 and second sidewall exterior portion 46 is folded upward with respect to base portion 26 along fold line 134.

First sidewall interior portion 48 is folded downward with respect to first sidewall exterior portion 44 towards base portion 26 along fold line 136. Second sidewall interior portion 50 is folded downward with respect to second sidewall exterior portion 46 towards base portion 26 along fold line 138. Tabs, if present, may be inserted within slots or cutouts within the base portion. Accordingly, in certain aspects of the present teaching, tabs 86 and 88 adjacent side edge 160 of the first sidewall interior portion 48 may be inserted respectively within slots 78 and 80 within base portion 26 and tabs 90 and 92 adjacent side edge 162 of second sidewall interior portion 50 may be inserted respectively within slots 82 and 84 of base portion 26.

In continuing to form the box, third sidewall portion 24 is folded upward along fold line 114 with respect to the base portion 26. The first side insert portion 52 is folded upward along fold line 140 with respect to the third sidewall portion 24 and the second side insert portion 54 is folded upward along fold line 142 with respect to the third sidewall portion 24. As the third sidewall portion 24 is folded upward along fold line 114 with respect to the base portion 26, the first side insert portion 52 may be positioned between the first sidewall exterior portion 44 and the first sidewall interior portion 48 secured in place by tabs 86 and 88 and slots 78 and 80 and the second side insert portion 54 may be positioned between the second sidewall exterior portion 46 and the second sidewall interior portion 50 secured in place by tabs 90 and 92 and slots 82 and 84.

In continuing to form the box, the fourth sidewall portion 28 is folded upward along fold line 116 with respect to the base portion 26. The first side insert portion 40 is folded upward along fold line 128 with respect to the fourth sidewall portion 28 and the second side insert portion 42 is folded upward along fold line 130 with respect to the fourth sidewall portion 28. As the fourth sidewall portion 28 is folded upward along fold line 116 with respect to the base portion 26, the first side insert portion 44 may be positioned between the first sidewall exterior portion 44 and the first sidewall interior portion 48 secured in place by tabs 86 and 88 and slots 78 and 80 and the second side insert portion 42 may be positioned between the second sidewall exterior portion 46 and the second sidewall interior portion 50 secured in place by tabs 90 and 92 and slots 82 and 84.

In continuing to form the box, the blank 10 may extend from the fourth sidewall portion 28 to a first cover portion 30. First cover portion 30 is folded upward along fold line 118 to form a first side of a hinged top cover of the box. The first cover portion 30 includes a first side portion 36 and a second side portion 38. First side portion 36 may be folded in a downward manner along fold line 124 with respect to cover portion 30. Second side portion 38 may be folded in a downward manner along fold line 126 with respect to the cover portion 30. When first cover portion 30 is in a closed configuration over a top portion of the box, first side portion 36 and second side portion 38 may fit within the interior of the box, in certain embodiments, being respectively positioned adjacent to the first sidewall interior portion 48 and second sidewall interior portion 50 of the box. The first cover portion 30 may further include a primary perforated strip 32 adjacent the side opposing fold line 118. The primary perforated strip 32 may include a first perforation line 120 at a side adjacent the first cover portion 30 and a second perforation line 122 at a side opposing the first perforation line 120. Adjacent the second perforation line 122, the first cover portion may include a secondary perforated strip 34 having a perforation along second perforation line 122.

In continuing to form the box, the blank 10 may extend from the third sidewall portion 24 to a second cover portion 22. Second cover portion 22 is folded upward along fold line 112 to form a second side of a hinged top cover of the box. The second cover portion 22 includes a first side portion 56 and a second side portion 58. First side portion 56 may be folded in a downward manner along fold line 144 with respect to cover portion 22. Second side portion 58 may be folded in a downward manner along fold line 146 with respect to the cover portion 22. When second cover portion 22 is in a closed configuration over a top portion of the box, first side portion 56 and second side portion 58 may fit within the interior of the box, in certain embodiments, being respectively positioned adjacent to the first sidewall interior portion 48 and second sidewall interior portion 50 of the box. According to certain aspects of the present teaching, the cover portion 22 may be described as being the exterior side of the second cover portion 22 and thus may be referred to as second cover exterior portion 22. According to further aspects of the present teaching, the blank 10 may further extend from the second cover exterior portion 22 to a second cover interior portion 20. Second cover interior portion 20 may be folded downward along fold line 110 with respect to second cover exterior portion 22 to form the interior side 20 of the second cover portion 22. According to further aspects of the present teaching, the combination of the second cover interior portion 20 and the second cover exterior portion 22 may be referred to as the second cover.

According to further aspects of the present teaching, a circular cutout 76 may be present along the center portion of fold line 110 with half or substantially half of the circular cutout within the second cover exterior portion 22 and half or substantially half of the circular cutout within the second cover interior portion 20. With the second cover interior portion 20 and the second cover exterior portion 22 folded along fold line 110, the circular cutout 76 forms a semicircular cutout along fold line 110 thereby forming a semicircular slot along the edge of the second cover. This semicircular slot may be used to provide an access point for a person to insert his or her finger or an instrument into to open the lift the second cover in an upward direction allowing for the first cover and second cover to be adjusted from a closed configuration in which the top portion of the box is covered to an open configuration wherein the top of the box is not covered or open allowing access to the interior portion of the box.

In continuing to form the box, the blank 10 may extend from the second cover interior portion 20 to a first platform intermediate portion 18, from first platform intermediate portion 18 to platform portion 16, from platform portion 16 to second platform intermediate portion 14 and from second platform intermediate portion 14 to first cover interior portion 12. First cover interior portion 12 may be secured to first cover exterior portion 30 by any mechanical or non-mechanical means within the purview of a person of suitable skill in the art. According to certain aspects of the present teaching, the first cover interior portion 12 is secured to the first cover exterior portion 30 through use of an adhesive. The adhesive may be applied to a bottom or interior side of the first cover exterior portion 30 and/or applied to a top side (not visible to the user when assembled) of the first cover interior portion 12.

The first platform intermediate portion 18 may include a first fold line 108 which separates the first platform intermediate portion 18 from second cover interior portion 20 and which provides a hinge between first platform intermediate portion 18 and second cover interior portion 20. The first platform intermediate portion 18 may include a second fold line 106 which separates the first platform intermediate portion 18 from platform portion 16 and which provides a hinge between first platform intermediate portion 18 and platform portion 16. The second platform intermediate portion 14 may include a first fold line 102 which separates the second platform intermediate portion 14 from first cover interior portion 12 and which provides a hinge between second platform intermediate portion 14 and first cover interior portion 12. The second platform intermediate portion 14 may include a second fold line 104 which separates the second platform intermediate portion 14 from platform portion 16 and which provides a hinge between second platform intermediate portion 14 and platform portion 16. The second cover interior portion 20, first platform intermediate portion 18, platform portion 16, second platform intermediate portion and first cover interior portion forms a lift mechanism within the interior of the box allowing for raising and lowering of the platform portion 16 with the opening and closing of the first cover and second cover of the box. This lift mechanism may also be referred to as an interior box elevator.

According to certain aspects of the present teaching platform portion 16 may include a first side support portion 60 and a second side support portion 62. As mentioned above, platform portion 16 includes a first platform intermediate portion 18 which extends from a first horizontal side of the platform portion 16 along fold line 106 and a second platform intermediate portion 14 which extends from a second opposing horizontal side of the platform portion 16 along fold line 104. First side support portion 60 extends from a first vertical side of platform portion 16 along fold line 148 and second side support portion 62 extends from a second vertical side of platform portion 16 along fold line 150. First side support portion 60 includes first side insert portion 64 which extends from fold line 152 and second side insert portion 66 which extends from fold line 154. Second side support portion 62 includes first side insert portion 68 which extends from fold line 156 and second side insert portion 70 which extends from fold line 158. In forming the box, first side support portion 60 is folded in a downward direction with respect to the platform portion 16 along fold line 148 and second side support portion 62 is folded in a downward direction with respect to platform portion 16 along fold line 150. With respect to first side support portion 60, first side insert portion 64 is folded in a clockwise inward direction along fold line 152 and second side insert portion 66 is folded in a counter clockwise inward direction along fold line 154. With respect to second side support portion 62, first side insert portion 68 is folded in a counter clockwise inward direction along fold line 156 and second side insert portion 70 is folded in a clockwise inward direction along fold line 158. Fold lines 152, 154, 156, and 158 on the blank 10, may horizontal or substantially horizontal or have an angle which renders the fold lines diagonal in shape. First side support portion 60 and second side support portion 62 act as a guide as the platform portion 16 moves in an upward and downward direction within the interior of the box ensuring that the platform portion 16 remains in its proper position within the interior of the box. First side support portion 60 and second side support portion 62 also provides structural support to platform portion 16 with respect to the inner sides of the box, i.e., first sidewall interior portion 48 and second sidewall interior portion 50. First side insert portion 64 and second side insert portion 66 of first side support portion 60 and first side insert portion 68 and second side insert portion 70 of second side support portion 62 ensures that first side support portion 60 and second side support portion 62 remain in their proper folded position and provides additional structural stability and support in combination with first side support portion 60 and second side support portion 62 to platform portion 16 allowing platform portion 16 to hold heavier weighted items when the box is in its closed configuration. This is accomplished by the bottom edges of first side support portion 60 (along with first side insert portion 64 and second side insert portion 66) and second side support portion 62 (along with first side insert portion 68 and second side insert portion 70) when in their folded position resting on the top interior surface of base portion 26.

According to further aspects of the present teaching, a first hinge support 74 may be positioned between first platform intermediate portion 18 and platform portion 16 and a second hinge support 72 may be position between second platform intermediate portion 14 and platform portion 16. The first hinge support 74 includes a first fold line 172 within the first platform intermediate portion 18 and a second fold line 170 within the platform portion 16. A first cutout 174 connects the first fold line 172 with the second fold line 170 on a first side of the second hinge support 74 and a second cutout 176 connects the first fold line 172 with the second fold line 170 on a second side of the first hinge support 74. The second hinge support 72 includes a first fold line 161 within the second platform intermediate portion 14 and a second fold line 164 within the platform portion 16. A first cutout 166 connects the first fold line 161 with the second fold line 164 on a first side of the second hinge support 72 and a second cutout 168 connects the first fold line 161 with the second fold line 164 on a second side of the second hinge support 72. When the box is assembled or in its 3-dimensional configuration, the first hinge support 74 and second hinge support forms a polyhedron-like structure having two flat surfaces and two ghost surfaces. The polyhedron-like structure may be rectangular or cubical in shape and the angles between each of the two flat surfaces, the flat and ghost surfaces and the two ghost surfaces adjusts with the opening and closing of the first cover and the second cover of the box. According to certain aspects of the present teaching, when both the first cover and the second cover are in a closed configuration, the angles between each of the two flat surfaces, the flat and ghost surfaces and the two ghost surfaces of the first hinge support 74 and the second hinge support 72 are at 90° or about 90° allowing the first hinge support 74 and the second hinge support 72 to form a rectangular-like or cube-like structure. As the first cover and the second cover are opened, for example at 90°, the angles between each of the two flat surfaces and the two ghost surfaces of the first hinge support 74 and the second hinge support 72 continually become more obtuse while the angle between the flat and ghost surfaces of the first hinge support 74 and the second hinge support 72 continually become more acute. As the first cover and second cover of the box continue to be opened beyond 90°, the appearance of the first hinge support 74 and the second hinge support 72 begins to flatten out. When the first cover and second cover are opened at 180°, the first hinge support 74 and the second hinge support 72 are completely flattened out and the platform 16 has been raised to its maximum height.

The first hinge support 74 and second hinge support 72 are designed to provide additional or extra structural support to the platform 16 as it is raised and lowered with the opening and closing of the first cover and the second cover. This additional structural support allows the platform 16 to support heavier weighted items that may be stored within the box.

In its closed unopened configuration, primary perforated strip 32 and secondary perforated strip 24 extend from the first cover portion 30. Primary perforated strip 32 extends over a center gap or opening between the first cover portion 30 and the second cover portion 22 and over a portion of the second cover portion 22. Secondary perforated strip 34 extends from the primary perforated strip 32 over the second cover portion 22. Primary perforated strip 32 and secondary perforated strip 34 have a top side which faces away from the interior of the box and a bottom side which faces towards the interior of the box. According to certain aspects of the present teaching, secondary perforated strip 34 includes an adhesive on its bottom side to adhere the secondary perforated strip to the second cover portion 22. This adhesive may alternatively or additionally be present on the top side of the second cover portion 22. According other aspects of the present teaching any other suitable means within the purview of a person of ordinary skill in the art may be used to fasten or adhere the secondary perforated strip 34 to the second cover portion 22. Thus, the set-up of the box in its closed configuration has been described with the primary perforated strip 32 extending from the first cover portion 30 over the gap or space between the first cover portion 30 and the second cover portion 22 and the secondary perforated strip 34 extending from the primary perforated strip 32 over the second cover portion 22 and fastened or adhered to the second cover portion 22. According to further aspects of the present teaching, the primary perforated strip 32 may include a pull tab at one or both ends of the primary perforated strip 32. This pull tab may be pulled by a user to lift the primary perforated strip 32 upwards and break the perforations at perforation lines 120 and 122, thus removing the primary perforated strip 32 from between the first cover portion 30 and the secondary perforated strip 34 attached to the second cover portion 22. Removing the primary perforated strip 32 exposes the space or gap between the first cover portion 30 and the second cover portion 22 allowing the user to open the box. According to further aspects of the present teaching, removing the primary perforated strip 32 exposes cutout 76 at the edge of the second cover portion. This cutout allows a user to insert his or her finger or another tool under the second cover portion allowing greater access to the space between the first cover portion 30 and the second cover portion 22 and easier opening of the first cover portion and the second cover portion.

The box is designed to be opened by lifting the first cover portion 30 and the second cover portion 22 upwards at the same time, although it is also possible to open the box to gain access to its interior by opening either the first cover portion 30 or the second cover portion 22 sequentially in either order or by opening either the first cover portion 30 or the second cover portion 22 alone or by itself. With the opening of the first cover portion 30 and the second cover portion 22, the platform 16 within the interior of the box moves in an upward direction or rises up from the interior of the box. Maximum height is achieved with the first cover portion 30 and the second cover portion 22 being lifted upwards up to 90° and subsequently downwards to a position wherein the first cover portion 30 and the second cover portion 22 are rotated 180° or about 180° along respective hinges or fold lines 118 and 112. With the closing of the first cover portion 30 and the second cover portion 22, the platform 16 within the interior of the box moves in an downward direction within the interior of the box.

Any item may be placed on the platform 16 within the interior of the box that is capable of fitting within the space provided between the top surface of the platform 16 and the bottom surface of the first cover portion and the bottom surface of the second cover portion as well as between the first intermediate platform portion 18 and the second intermediate platform portion 14. According to certain aspects of the present teaching, the platform 16 within the interior of the box provides a space which is sufficient for holding a second smaller box. Thus, opening the first cover portion 30 and the second cover portion 22 causes the platform carrying a second smaller box to raise upward from the interior of the box. This second smaller box may thus be displayed when the box is in its open configuration allowing customers to view the contents of the box 10. Moreover, using a platform 16 and lifting mechanism described above results in lifting of the second smaller box or other items from the interior of the box providing users with easier access to the second smaller box or other items making it much easier to remove the second smaller box or other items from the interior of the box.

FIGS. 16-19 illustrate an alternative embodiment of a box having a lift mechanism/levitation device. Formation of the box will now be discussed with reference to FIG. 19. Before the box is formed, the box has a one-dimensional configuration and comprises a blank 210 having a plurality of fold lines. The blank may be initially flat and may be folded along its fold lines to form a three-dimensional configuration of the box. The blank includes an outer side and an inner side. The outer side of the blank forms the exterior facing surface of the box when it is in its three-dimensional configuration. The inner side of the blank forms the interior facing surface of the box when it is in its three-dimensional configuration. The blank may be made of any material known by persons of ordinary skill in the art to be suitable for forming a box.

According to certain aspects of the present teaching, the blank 210 includes a plurality of different sections referred to herein as portions which are separated by various fold lines. Formation of the box from its one-dimensional configuration to its three-dimensional configuration may begin with the first sidewall portion 212 and second sidewall portion 214 of the box blank 210 folded along fold line 236 at a right angle or substantially right angle. The second sidewall portion 214 and the third sidewall portion 216 is then folded along fold line 238 at a right angle or substantially right angle. The third sidewall portion 216 and the fourth sidewall portion 218 is then folded along fold line 240 at a right angle or substantially right angle. Sidewall portion tab 290 may then be folded along fold line 258 and inserted within the interior side or positioned along a portion of the exterior side of first sidewall portion 212. Sidewall portion tab 290 may then be adhered to an interior or exterior portion of first sidewall portion 212 to complete the formation of the sidewalls of the box (i.e., the circumference of the box). According to certain aspects of the present teaching, sidewall portion tab 290 includes an adhesive strip on at least a portion of one of its sides for this purpose. A layer of tape may also be used alternatively or additionally for this purpose.

The bottom portion of the box 200 is formed by folding a series of bottom cover portions of the box along a series of fold lines. Folding of the bottom cover portions may be described as being in an upward manner. Moreover, the bottom cover portions may all be folded in a clockwise manner or may all be folded in a counterclockwise manner depending on how the sidewall portions are folded. First, second bottom cover portion 222 is folded along fold line 244 to form a right angle or substantially right angle when closed with respect to second sidewall portion 214 and fourth bottom cover portion cover 226 is folded along fold line 248 to form a right angle or substantially right angle when closed with respect to fourth sidewall portion 218. Next, first bottom cover portion 220 is folded along fold line 242 to form a right angle or substantially right angle when closed with respect to first sidewall portion 212 and third bottom cover portion 224 is folded along fold line 246 to form a right angle or substantially right angle when closed with respect to third sidewall portion 216. However, it is to be understood that the first bottom cover portion 220 and the third bottom cover portion 224 may be folded first and subsequently second bottom cover portion 222 and fourth bottom cover portion 226 may be folded to form the bottom portion of the box 200. The various bottom cover portions may be secured together by use of an adhesive, tape, a fastener including but not limited to a staple or any other type of fastener or any other suitable means within the purview of a person of ordinary skill in the art.

The top portion of the box 200 is formed by folding a series of top cover portions of the box along a series of fold lines. Folding of the top cover portions may be described as being in an downward manner. Moreover, the top cover portions may all be folded in a clockwise manner or may all be folded in a counterclockwise manner depending on how the sidewall portions are folded. First, second top bottom cover portion 230 is folded along fold line 252 to form a right angle or substantially right angle when fully closed with respect to second sidewall portion 214 and fourth top cover portion cover 234 is folded along fold line 256 to form a right angle or substantially right angle when closed with respect to fourth sidewall portion 218. Next, first top cover portion 228 is folded along fold line 250 to form a right angle or substantially right angle when closed with respect to first sidewall portion 212 and third top cover portion 232 is folded along fold line 254 to form a right angle or substantially right angle when closed with respect to third sidewall portion 216. However, it is to be understood that the first top cover portion 228 and the third top cover portion 232 may be folded first and subsequently second top cover portion 230 and fourth top cover portion 234 may be folded to form the top portion of the box 200. The various bottom cover portions may be secured together by use of an adhesive, tape, a fastener, including but not limited to a pull tab and perforated strip as described above, a staple or any other type of fastener, or any other suitable means within the purview of a person of ordinary skill in the art.

Although not shown in FIGS. 16-19, it is contemplated that the embodiment shown in these figures may include a primary perforated strip (similar to primary perforated strip 32) and a secondary perforated strip (similar to secondary perforated strip 34) each of which extends from one of the top cover portions of the box. The bottom portion of secondary perforated strip may adhered or attached to an opposing top cover portion in a manner similar to how secondary perforated strip is adhered or attached to cover 22 when the box is in a closed configuration. To open the box, the primary perforated strip may be lifted and pulled along its perforation lines and removed from the top of the box. Alternatively, to open the box, the secondary perforated strip may be pulled upwards and detached from the top portion of the top cover portion of the box. In certain embodiments, a semicircular cutout (similar to semicircular cutout 76) may be present along the edge of one of the top cover portions under primary perforated strip. This cutout provides the user with access to the top cover portions and allows the user to insert his or her finger or a tool under one or more of the top cover portions to open the box.

Figure 16:
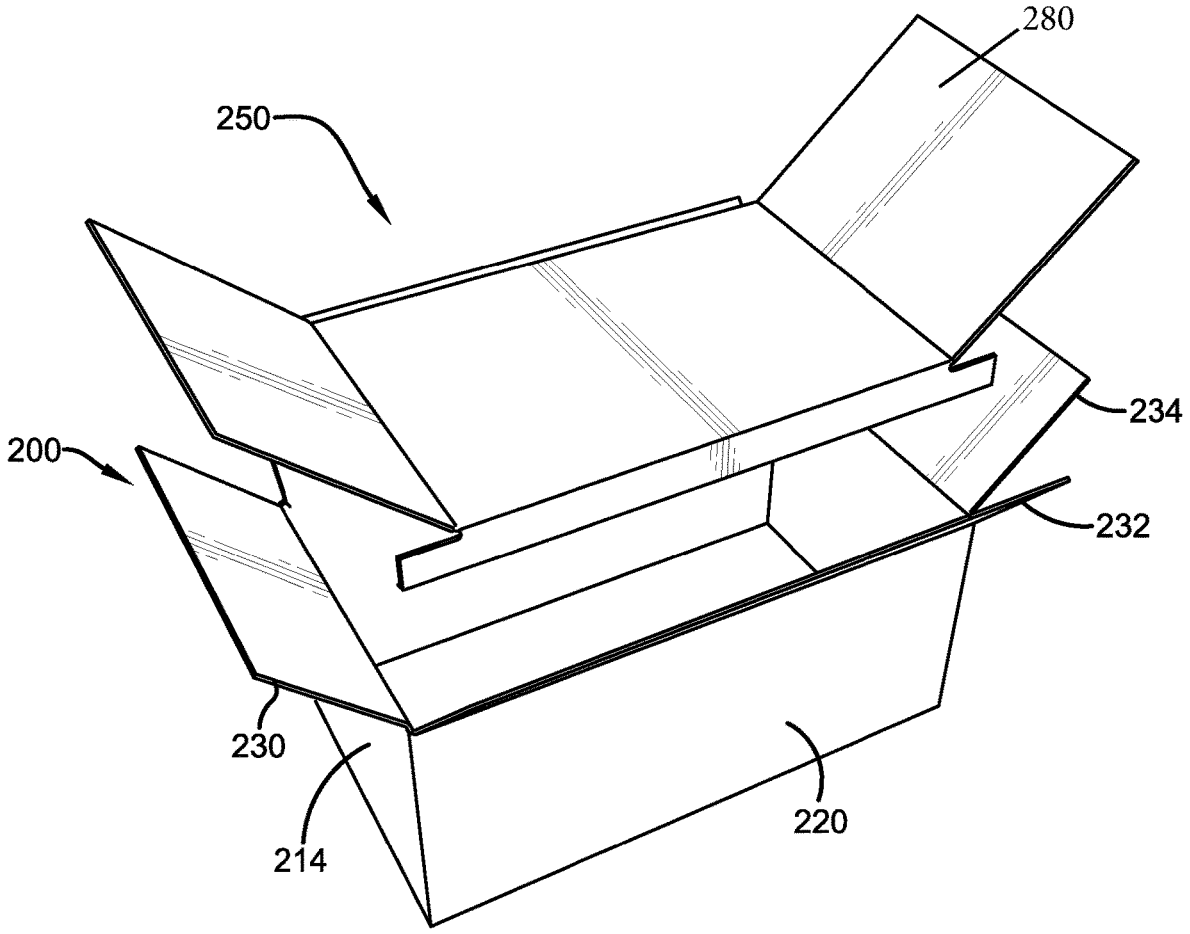
FIG. 16 is a perspective, exploded view of a second embodiment of a box with a lift mechanism.
Figure 17:
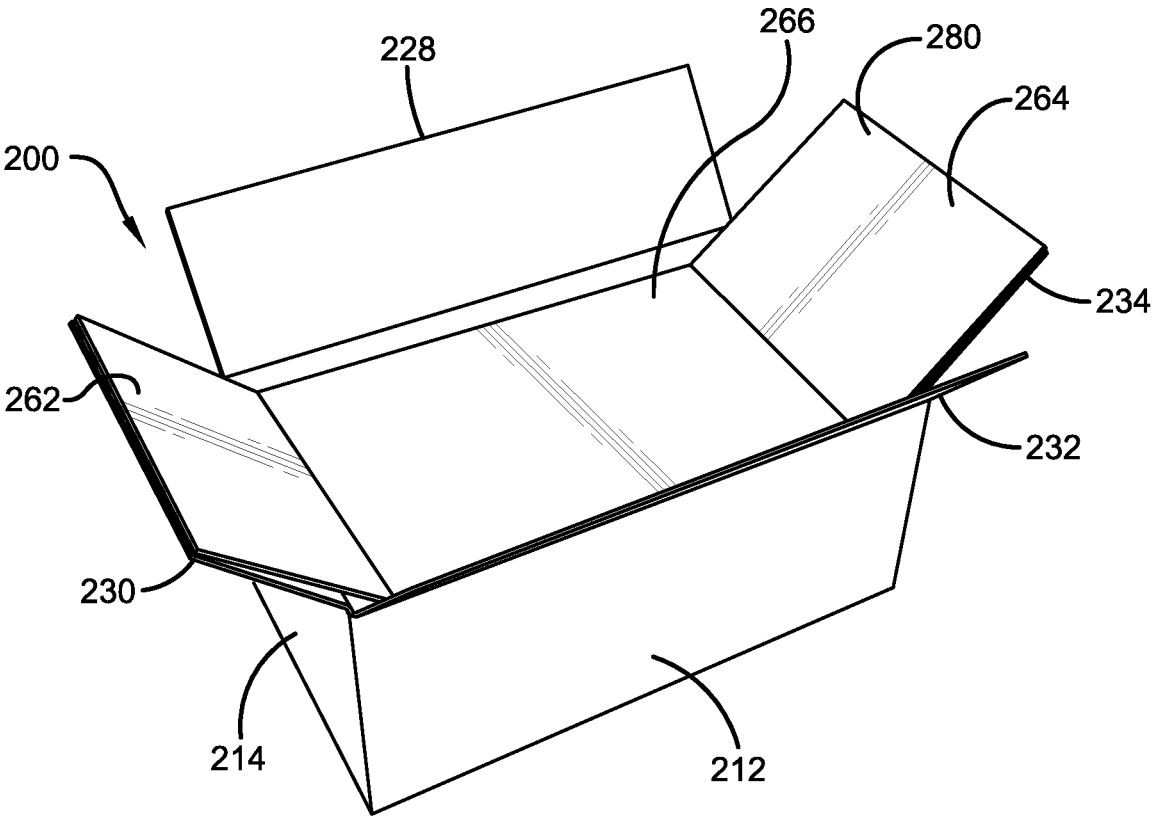
FIG. 17 is a perspective view of a second embodiment of a box with a lift mechanism.
Figure 18:
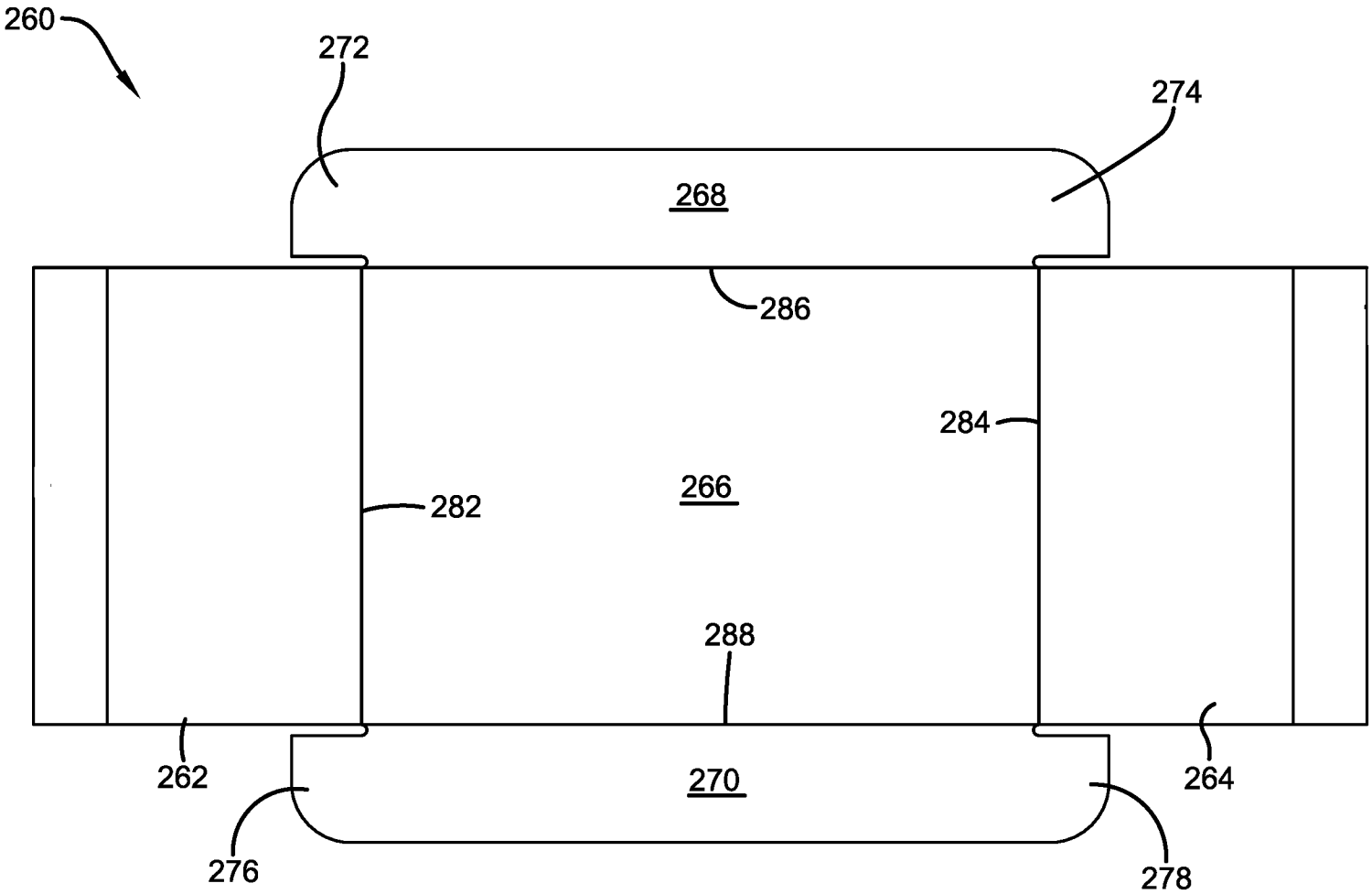
FIG. 18 is a planar view of a lift mechanism blank which may be folded and shaped to form the lift mechanism of FIGS. 16 and 17.
Figure 19:
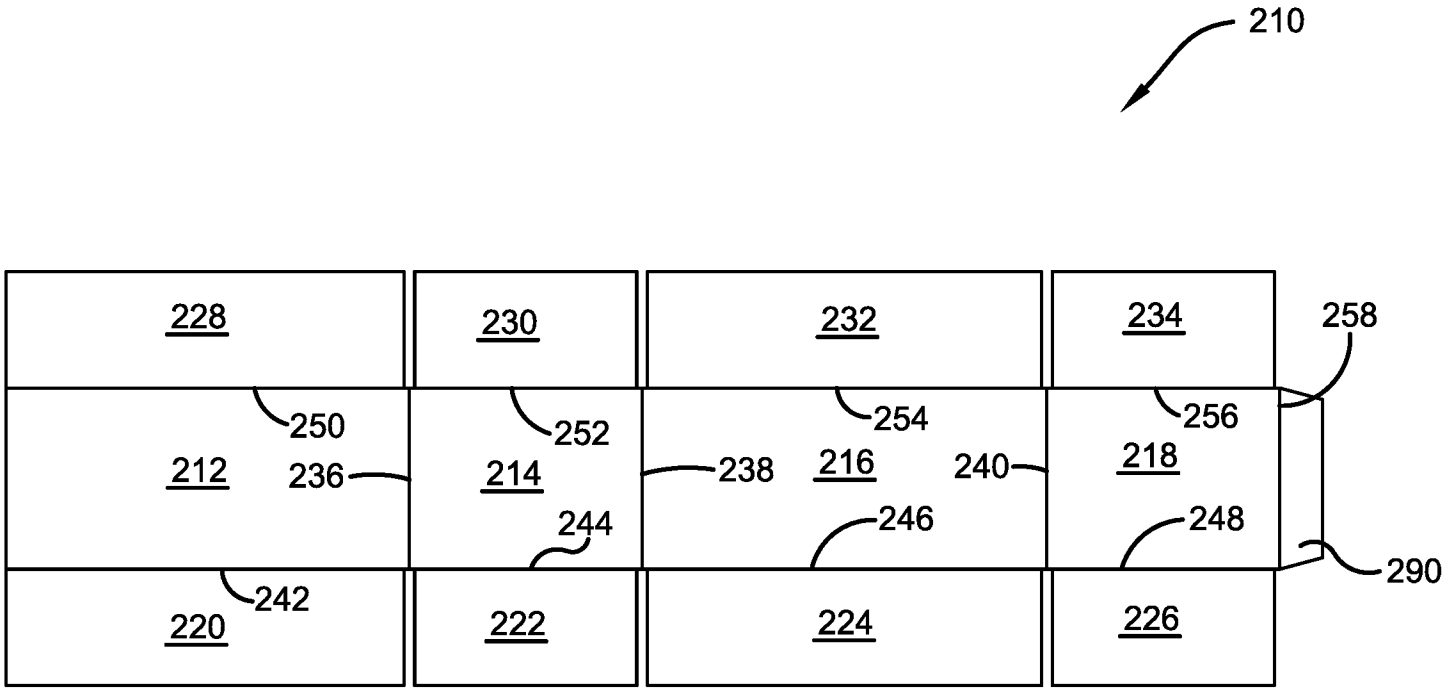
FIG. 19 is a planar view of a box blank which may be folded and shaped to form the box of FIGS. 16 and 17.

The box 200 may further include an insert 280 as shown in FIG. 16 which forms the lift mechanism/levitational device illustrated within FIG. 17. The insert 280 is formed by insert blank 260 shown in FIG. 18. The insert blank 260 includes a liftable platform portion 266 a first inside cover portion 262 and a second inside cover portion 264. First inside cover portion 262 is folded along fold line 282 and attached to the inside surface of first top cover portion 230. Second inside cover portion 264 is folded along fold line 284 and is attached to the inside surface of fourth top cover portion 234. This attachment may be accomplished through use of an adhesive, a fastener (e.g., a staple) or any other suitable means within the purview of a person of ordinary skill in the art. For example, as shown in FIG. 18, first inside cover portion 262 includes an adhesive or adhesive strip along the length of its outer edge and second inside cover portion 264 includes an adhesive or adhesive strip along the length of its outer edge. This adhesive may be used to attach the first inside cover portion 262 and the second inside cover portion respectively to the inside surface of the second cover portion 230 and the fourth cover portion 234 of the box 200. This attachment allows the platform portion 266 to vertically move in an upward direction with the opening of first top cover portion 230 and second top cover portion 264 and to vertically move in a downward direction with the closing of first top cover portion 230 and second top cover portion 264 as shown in FIG. 17.

In further aspects of the present teaching, the insert 280 may include a first side portion 268 and a second side portion 270. First side portion 268 is folded along fold line 286 in a downward or counterclockwise direction with respect to the top surface of the platform portion 266. Second side portion 270 is folded along fold line 288 in a downward or clockwise direction with respect to the top surface of platform portion 266. First side portion 268 and second side portion 270 act as a guide for the platform portion 266 as the platform portion vertically moves within the box, i.e., in an upward direction with the opening of the cover portions of the box or a downward direction with the closing of the cover portions of the box. First side portion 268 and second side portion 270 also provide structural stability to the platform portion 266. First side portion 268 and second side portion 270 rests on the bottom surface of the interior of the box 200 when the box is in its closed configuration. This allows the platform portion 266 to hold and carry relatively heavier weighted items during shipping and storage.

In further aspects of the present teaching, first side portion 268 includes first side insert portion 272 and second side insert portion 274 which may be folded inwards towards the interior portion of the box and second side portion 270 includes first side insert portion 276 and second side insert portion 278 which may also be folded inwards towards the interior portion of the box. These side insert portions provide further stability and support to the platform portion 266, particularly when the platform portion 266 rests on the top surface of the bottom portion of the box when the box is in its closed configuration. The additional stability and support allows the platform portion 266 to hold and carry relatively heavier weighted items during shipping and storage. The complete assembly of the box blank 210 and the insert blank 260 forming the insert 280 is shown in FIG. 17 which illustrates the box 200 in its open configuration with the platform 266 in a raised or elevated position.

The box embodiments described above may be formed by folding the various components of the box blanks along the respective fold lines in various directions as described above. Moreover, although the box blanks described above have a top surface and a bottom surface, in certain instances reference to the top surface and bottom surface of the various components of the box blank are made with respect to the assembled box.

LISTING OF REFERENCE NUMBERS

10—blank;
12—first cover interior portion;
14—second platform intermediate portion;
16—platform portion;
18—first platform intermediate portion;
20—second cover interior portion;
22—second cover exterior portion;
24—third sidewall portion;
26—base portion;
28—fourth sidewall portion;
30—first cover portion;
32—primary perforated strip;
34—secondary perforated strip;
36—first side portion of first cover portion;
38—second side portion of first cover portion;
40—first side insert of fourth sidewall portion;
42—second side insert of fourth sidewall portion;
44—first sidewall exterior portion;
46—second sidewall exterior portion;
48—first sidewall interior portion;
50—second sidewall interior portion;
52—first side insert of third sidewall portion;
54—second side insert of third sidewall portion;
56—first side portion of second cover exterior portion;
58—second side portion of second cover exterior portion;
60—first side support portion of platform portion 16;
62—second side support portion of platform portion 16;
64—first side insert portion (side insert tab portion) of first side support portion 60;
66—second side insert portion (side insert tab portion) of first side support portion 60;
68—first side insert portion (side insert tab portion) of second side support portion 62;
70—second side insert portion (side insert tab portion) of second side support portion 62;
72—second hinge support;
74—first hinge support;
76—circular cutout;
78—slot;
80—slot;
82—slot;
84—slot;
86—tab;
88—tab;
90—tab;
92—tab;
100—box;
102—first fold line of second platform intermediate portion 14;
104—second fold line of second platform intermediate portion 14;
106—second fold line of first platform intermediate portion 18;
108—first fold line of first platform intermediate portion;
110—fold line between second cover interior portion 20 and second cover portion 22;
112—fold line between second cover portion 22 and third sidewall portion 24;
114—fold line between third sidewall portion 24 and base portion 26;
116—fold line between base portion 26 and fourth sidewall portion 28;
118—fold line between fourth sidewall portion 28 and first cover portion 30;
120—first perforation line between first cover portion 30 and primary perforated strip 32;
122—second perforation line between primary perforated strip 32 and secondary perforated strip 34;
124—fold line between first cover portion 30 and first side portion of first cover portion 38;
126—fold line between first cover portion 30 and second side portion of first cover portion 38;
128—fold line between fourth sidewall portion 28 and first side insert portion 40;
130—fold line between fourth sidewall portion 28 and second side insert portion 42;
132—fold line between base portion 26 and first sidewall exterior portion 44;
134—fold line between base portion 26 and second sidewall exterior portion 46;
136—fold line between first sidewall exterior portion 44 and first sidewall interior portion 48;
138—fold line between second sidewall exterior portion 46 and second sidewall interior portion 50;
140—fold line between third sidewall portion 24 and first side insert of third sidewall portion 52;
142—fold line between third sidewall portion 25 and second side insert of third sidewall portion 52;
144—fold line between second cover exterior portion 22 and first side portion of second cover exterior portion 56;
146—fold line between second cover exterior portion 22 and second side portion of second cover exterior portion 58;
148—fold line between platform portion 16 and first side support portion 60;
150—fold line between platform portion 16 and second side support portion 62;
152—fold line between first side support portion 60 and first side insert portion 64;
154—fold line between first side support portion 60 and second side insert portion 66;
156—fold line between second side support portion 62 and first side insert portion 68;
158—fold line between second side support portion 62 and second side insert portion 70;
160—side edge of first sidewall interior portion 48;
161—first fold line of second hinge support 72;
162—side edge of second sidewall interior portion 50;
164—second fold line of second hinge support 72;
166—first cutout of second hinge support 72;
168—second cutout of second hinge support 72;
170—first fold line of first hinge support 74;
172—second fold line of first hinge support 74;
174—first cutout of first hinge support 74;
176—second cutout of first hinge support 74;
200—box;
210—box blank;
212—first sidewall portion of box;
214—second sidewall portion of box;
216—third sidewall portion of box;
218—fourth sidewall portion of box;
220—first bottom cover portion of box;

222—second bottom cover portion of box;
224—third bottom cover portion of box;
226—fourth bottom cover portion of box;
228—first top cover portion of box;
230—second top cover portion of box;
232—third top cover portion of box;
234—fourth top cover portion of box;
236—fold line between first sidewall portion 212 and second sidewall portion 214;
238—fold line between second sidewall portion 214 and third sidewall portion 216;
240—fold line between third sidewall portion 216 and fourth sidewall portion 218;
242—fold line between first sidewall portion 212 and first bottom cover portion 220;
244—fold line between second sidewall portion 214 and second bottom cover portion 222;
246—fold line between third sidewall portion 216 and third bottom cover portion 224;
248—fold line between fourth sidewall portion 218 and fourth bottom cover portion 226;
250—fold line between first sidewall portion 212 and first top cover portion 228;
252—fold line between second sidewall portion 214 and second top cover portion 230;
254—fold line between third sidewall portion 216 and third top cover portion 232;
256—fold line between fourth sidewall portion 218 and fourth top cover portion 234;
258—fold line between fourth sidewall portion 218 and sidewall portion tab 290;
260—insert blank;
262—first inside cover portion of insert blank 260;
264—second inside cover portion of insert blank 260;
266—platform portion of insert blank 260;
268—first side portion of insert blank 260;
270—second side portion of insert blank 260;
272—first side insert portion of first side portion 268;
274—second side insert portion of first side portion 268;
276—first side insert portion of second side portion 270;
278—second side insert portion of second side portion 270;
280—insert which forms lift mechanism/levitational device;
282—fold line between first inside cover portion 262 and platform portion 266;
284—fold line between second inside cover portion 264 and platform portion 266;
286—fold line between first side portion 268 and platform portion 266;
288—fold line between second side portion 270 and platform portion 266;
290—sidewall portion tab While the present invention has been illustrated by the description of exemplary embodiments thereof, and while the embodiments have been described in considerable detail, they are not intended to restrict or in any way limit the scope of the appended claims to such detail. Additional advantages and modifications will readily appear to those skilled in the art. As a non-limiting example, while operation of various box embodiments have been described herein, it will be appreciated that the box may alternatively be configured and designed. Moreover, the various features disclosed herein may be used alone or in any desired combination. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A box blank comprising:

a base portion having a first side, a second side, a third side and a fourth side;

a first sidewall exterior portion which extends from the first side of the base portion and a second sidewall exterior portion which extends from the second side of the base portion;

a third sidewall portion which extends from the third side of the base portion, wherein the third sidewall portion has a first side, a second side a third side and a fourth side;

a fourth sidewall portion which extends from the fourth side of the base portion, wherein the fourth sidewall portion has a first side, a second side, a third side and a fourth side;

a first cover portion which extends from the fourth side of the fourth sidewall portion, the first cover portion having a first side, a second side, a third side and a fourth side;

a second cover exterior portion which extends from the third side of the third sidewall portion, wherein the second cover exterior portion has a first side, a second side, a third side and a fourth side;

a second cover interior portion which extends from the third side of the second cover exterior portion, wherein the second cover interior portion has a first side, a second side, a third side and a fourth side;

a first platform intermediate portion which extends from the third side of the second cover interior portion, wherein the first platform intermediate portion has a first side, a second side, a third side and a fourth side;

a platform portion which extends from the third side of the first platform intermediate portion, wherein the platform portion has a first side, a second side, a third side and a fourth side;

a second platform intermediate portion which extends from the third side of the platform portion, wherein the second platform intermediate portion has a first side, a second side, a third side and a fourth side; and a first cover interior portion which extends from the third side of the second platform intermediate portion, wherein the first cover interior portion has a first side, a second side, a third side and a fourth side, wherein:

the third sidewall portion comprises a first side insert which extends from the first side of the third sidewall portion and a second side insert which extends from the second side of the third sidewall portion, the fourth sidewall portion comprises a first side insert which extends from the first side of the fourth sidewall portion and a second side insert which extends from the second side of the fourth sidewall portion, the first sidewall portion comprises a first sidewall interior portion which extends from the first side of the first sidewall portion, and the second sidewall portion comprises a second sidewall interior portion which extends from the second side of the second sidewall portion.

2. The box blank of claim 1, wherein:

the first sidewall interior portion comprises at least one tab which extends from its second side and the base portion comprises at least one slot corresponding to said tab, and the second sidewall interior portion comprises at least one tab which extends from its second side and the base portion comprises at least one slot corresponding to said tab.

3. The box blank of claim 2, wherein:

the first cover portion comprises a first side portion which extends from the first side of the first cover portion and a second side portion which extends from the second side of the first cover portion; and the second cover exterior portion comprises a second side portion which extends from the first side of the second cover exterior portion and a second side portion which extends from the second side of the second cover exterior portion.

4. The box blank of claim 3 further comprising a cutout which overlaps a portion where the second cover exterior portion meets the second cover interior portion.

5. The box blank of claim 4, wherein the first cover portion comprises a primary perforated strip having a first side, a second side, a third side and a fourth side, wherein the primary perforated strip extends from the fourth side of the first cover portion and a secondary perforated strip which extends from the fourth side of the primary perforated strip.

6. The box blank of claim 5 further comprising:

a first hinge support which overlaps a portion where the fourth side of the platform portion meets the first platform intermediate portion; and a second hinge support which overlaps a portion where the third side of the platform portion meets the second platform intermediate portion.

7. The box blank of claim 6, wherein the first hinge support and the second hinge support each comprise a first linear cutout and a second linear cutout on a side opposing the first linear cutout.

8. The box blank of claim 7, wherein the platform portion comprises:

a first side support portion which extends from the first side of the platform portion, and a second side support portion which extends from the second side of the platform portion.

9. The box blank of claim 8, wherein:

the first side support portion of the platform portion comprises a first side insert tab portion at a first end of the first side support portion and a second side insert tab portion at a second opposing end of the first side support portion, and the second side support portion of the platform portion comprises a first side insert tab portion at a first end of the first second side support portion and a second side insert tab portion at a second opposing end of the second side support portion.

10. The box blank of claim 9, wherein the first cover portion comprises a bottom surface having an applied adhesive and/or the first cover interior portion comprises a top surface having an applied adhesive.

11. The box blank of claim 10 further comprising:

a fold line between the first sidewall exterior portion and the base portion;

a fold line between the second sidewall exterior portion and the base portion;

a fold line between the third sidewall portion and the base portion;

a fold line between the fourth sidewall portion and the base portion;

a fold line between the fourth sidewall portion and the first cover portion;

a fold line between the third sidewall portion and the second cover exterior portion;

a fold line between the second cover exterior portion and the second cover interior portion;

a fold line between the second cover interior portion and the first platform intermediate portion;

a fold line between the first platform intermediate portion and the second cover interior portion;

a fold line between the first platform intermediate portion and the platform portion;

a fold line between the platform portion and the second platform intermediate portion;

a fold line between the second platform intermediate portion and the first cover interior portion;

a fold line between the first sidewall exterior portion and the first sidewall interior portion;

a fold line between the second sidewall exterior portion and the second sidewall interior portion;

a fold line between the third sidewall portion and the first side insert of the third sidewall portion;

a fold line between the third sidewall portion and the second side insert of the third sidewall portion;

a fold line between the fourth sidewall portion and the first side insert of the fourth sidewall portion;

a fold line between the fourth sidewall portion and the second side insert of the fourth sidewall portion;

a fold line between first cover portion and the first side portion of the first cover portion;

a fold line between the first cover portion and the second side portion of the first cover portion;

a fold line between the second cover exterior portion and the first side portion of the second cover exterior portion;

a fold line between the second cover exterior portion and the second side portion of the second cover exterior portion;

a first perforation line between the first cover portion and the primary perforated strip;

a second perforation line between the primary perforated strip and the secondary perforated strip;

a fold line between the platform portion and the first side support portion of the platform portion;

a fold line between the platform portion and the second side support portion of the platform portion;

a fold line between the first side support portion and the first side insert tab portion of the first side support portion of the platform portion;

a fold line between the first side support portion and the second side insert tab portion of the first side support portion of the platform portion;

a fold line between the second side support portion and the first side insert tab portion of the second side support portion of the platform portion; and, a fold line between the second side support portion and the second side insert tab portion of the second side support portion of the platform portion.

12. A method of forming a box according to claim 11 comprising:

folding the first sidewall portion and the second sidewall portion upwards with respect to the base portion;

folding the first sidewall interior portion with respect to the first sidewall exterior portion and inserting the at least one tab extending from the first sidewall interior portion within the at least one corresponding slot within the base;

folding the second sidewall interior portion with respect to the second sidewall exterior portion and inserting the at least one tab extending from the second sidewall interior portion within the at least one corresponding slot within the base;

folding the third sidewall portion upwards with respect to the base portion;

folding the fourth sidewall portion upwards with respect to the base portion;

folding the first side insert and the second side insert of the third sidewall portion inward with respect to a top surface of the third sidewall portion and inserting the first side insert between the first sidewall exterior portion and first sidewall interior portion and second side insert between the second sidewall exterior portion and second sidewall interior portion;

folding the first side insert and the second side insert of the fourth sidewall portion inward with respect to a top surface the fourth sidewall portion and inserting the first side insert between the first sidewall exterior portion and first sidewall interior portion and second side insert between the second sidewall exterior portion and second sidewall interior portion;

folding the first cover portion with respect to the fourth sidewall portion towards a top surface of the base portion;

folding the first side portion and the second side portion of the first cover portion inward with respect to a bottom surface of the first cover portion;

folding the second cover exterior portion with respect to the third sidewall portion towards a top surface of the base portion;

folding the first side portion and the second side portion of the second cover exterior portion inward with respect to a bottom surface of the second cover exterior portion;

folding the second cover interior portion over the second cover exterior portion and bringing the first platform intermediate portion, platform portion, first side portion of platform portion, second side portion of platform portion, second platform intermediate portion and first cover interior portion over the top surface of the base of the box as a unit;

folding the first side support portion and second side support portion in a downward direction with respect to the platform portion;

folding the first side insert tab portion and second side insert tab portion of the first side support portion of the platform in an inward direction with respect to the platform to position the first side insert tab portion and second side insert tab portion under the platform;

folding the first side insert tab portion and second side insert tab portion of the second side support portion of the platform in an inward direction with respect to the platform to position the first side insert tab portion and second side insert tab portion under the platform; and securing the first cover interior portion to a bottom surface of the first cover portion.

13. The method of claim 12, wherein the step of securing the first cover interior portion to the bottom surface of the first cover portion comprises application of an adhesive.

14. A box comprising an interior lift mechanism comprising:

an exterior box structure comprising a first sidewall, a second sidewall, a third sidewall, a fourth sidewall, a bottom surface and at least two cover portions; and a platform portion positioned over the bottom surface of the box within the interior of the box, wherein the platform portion extends on a first side to a first cover interior portion and wherein the platform portion extends on a second opposing side to a second cover interior portion, wherein the first cover interior portion of the platform portion and the second cover interior portion of the platform portion are connected respectively to a bottom surface of a first cover and to a bottom surface of a second cover of the box, wherein the bottom surface of the box comprises a single bottom portion or more than one bottom cover portions, and wherein the platform portion comprises a first side support portion and a second side support portion each of which extends along a length of the platform portion, wherein the each of the first side support portion and second side support portion comprises a first side insert tab portion at one end of the respective side support portion and a second side insert tab portion at a second opposing end of the side insert portion.

15. The box of claim 14, wherein the first cover interior portion extending from the platform is adhesively attached to the bottom surface of the first cover and the second cover interior portion extending from the platform is adhesively attached to the bottom surface of the second cover.

16. The box of claim 14, wherein a bottom surface of a first cover portion is adhesively attached to the first cover interior portion which extends from the platform portion and the second cover interior portion extends from a second cover portion and is folded at a fold line under a bottom surface of the second cover, wherein box comprises a first hinge support between the platform portion and the first cover interior portion and a second hinge support between the platform portion and the second cover interior portion, wherein the box comprises a primary perforation strip which extends from the first cover portion at a first perforation line and a secondary perforation strip which extends from the primary perforation strip at a second perforation line and wherein the second cover portion includes a cutout along the fold line between the second cover portion and the second cover interior portion.

* * * * *